US008398070B2

(12) United States Patent
Todoriki et al.

(10) Patent No.: US 8,398,070 B2
(45) Date of Patent: Mar. 19, 2013

(54) VALVE UNIT AND PAPER SHEET TAKEOUT DEVICE

(75) Inventors: Toru Todoriki, Kawasaki (JP); Yusuke Mitsuya, Yokohama (JP); Yoshihiko Naruoka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/550,685

(22) Filed: Aug. 31, 2009

(65) Prior Publication Data

US 2010/0207315 A1 Aug. 19, 2010

(30) Foreign Application Priority Data

Feb. 19, 2009 (JP) ..... 2009-036878

(51) Int. Cl.
*B65H 5/12* (2006.01)

(52) U.S. Cl. ..... 271/12; 271/11; 271/96

(58) Field of Classification Search ..... 271/11, 271/12, 96; 137/595
See application file for complete search history.

(56) References Cited

U.S. PATENT DOCUMENTS

| | | | | |
|---|---|---|---|---|
| 5,129,420 | A * | 7/1992 | Johnson | 137/595 |
| 5,248,325 | A * | 9/1993 | Kagimoto et al. | 96/124 |
| 5,391,051 | A | 2/1995 | Sabatier et al. | |
| 6,186,491 | B1 * | 2/2001 | Tomiyama et al. | 271/12 |
| 6,575,450 | B2 * | 6/2003 | Blackwell et al. | 271/11 |

FOREIGN PATENT DOCUMENTS

| | | |
|---|---|---|
| CN | 1648499 | 8/2005 |
| CN | 201206063 Y | 3/2009 |

OTHER PUBLICATIONS

Chinese Office Action dated Sep. 23, 2011.

* cited by examiner

*Primary Examiner* — Kaitlin Joerger
(74) *Attorney, Agent, or Firm* — Pillsbury Winthrop Shaw Pittman, LLP

(57) ABSTRACT

A valve unit which circulates and blocks air has a first block connected to upstream suction tubes, a second block facing this first block and connected to downstream suction tubes, a shield plate disposed in a space S between the first block and the second block, and a motor which rotates this shield plate. The shield plate is provided with a connection hole which connects the upstream suction tube to the downstream suction tube, and a connection hole which connects the upstream suction tube to the downstream suction tube.

10 Claims, 14 Drawing Sheets

VALVE UNIT AND PAPER SHEET TAKEOUT DEVICE

CROSS-REFERENCE TO RELATED APPLICATIONS

This application is based upon and claims the benefit of priority from prior Japanese Patent Application No. 2009-036878, filed Feb. 19, 2009, the entire contents of which are incorporated herein by reference.

BACKGROUND OF THE INVENTION

1. Field of the Invention

The present invention relates to a valve unit for circulating and blocking flowing subjects. In particular, it relates to a paper sheet takeout device which forwards, adsorbs onto a belt, and successively takes out superimposed paper sheets one by one.

2. Description of the Related Art

Heretofore, as a paper sheet takeout device, there has been known a device which runs a perforated belt along mail articles, sucks holes of the belt by a suction nozzle disposed on the backside of the belt to adsorb the mail articles onto the surface of the belt, and takes out the mail articles one by one (e.g., see U.S. Pat. No. 5,391,051). A solenoid valve is attached between the suction nozzles and a vacuum tank.

Thus, to take out the mail articles, the belt is run, and the solenoid valve is opened to adsorb each mail article onto the belt by the suction nozzle. To continuously take out the mail articles, the solenoid valve is periodically closed in accordance with a timing to take out each mail article, thereby forming a gap between the preceding mail article and the subsequent mail article to be taken out.

However, even when the solenoid valve is closed to stop the suction by the suction nozzles, a negative pressure acting on the mail articles cannot immediately be eliminated while the mail articles are adsorbed onto the belt. Therefore, to take out the mail articles at the high speed, even when the belt is run at the high speed and the opening/closing period of the solenoid valve is shortened, the negative pressure actually acting on the mail articles cannot immediately be eliminated, and hence the mail articles cannot be taken out at the high speed while the gap is provided between the mail articles. Moreover, when the negative pressure cannot immediately be eliminated, two mail articles are taken out while superimposed, and hence, superimposed conveyance easily occurs.

FIGS. 21 and 22 show schematic diagrams of a usual conventional solenoid valve 100. FIG. 21 shows that the solenoid valve 100 is opened, and FIG. 22 shows that the solenoid valve 100 is closed.

In general, the solenoid valve 100 has a coil 104 which moves a substantially cylindrical plunger 102 in an axial direction, a substantially cylindrical chamber 106 (shown only in FIG. 21) which contains the plunger 102, and two holes 108*a*, 109*a* formed in the bottom of this chamber 106 to connect two pipes 108, 109 to each other. When this solenoid valve 100 is used in the device of Patent Document 1 described above, the two pipes 108, 109 are connected to a suction nozzle and a vacuum tank, respectively.

When this solenoid valve 100 is opened, the coil 104 is energized to draw out the plunger 102 from the chamber 106, so that the two holes 108*a*, 109*a* are connected to each other through the chamber 106. On the other hand, when this solenoid valve 100 is closed, the energizing of the coil 104 is stopped to push the plunger 102 into the chamber 106, so that the bottom surface of the plunger 102 closely comes into contact with the bottom of the chamber 106. In consequence, the two holes 108*a*, 109*a* are closed to block a flow path 110 which connects the two pipes 108, 109 to each other.

However, this type of solenoid valve 100 is opened or closed by moving the plunger 102 in the axial direction, and hence an inertia is large. In particular, when the diameters of the pipes 108, 109 connected to the solenoid valve 100 are increased to increase the flow rate of air, the diameter of the plunger 102 for closing the holes 108*a*, 109*a* also needs to be increased, and the inertia also increases accordingly.

Moreover, when the solenoid valve 100 is opened, the coil 104 is energized to move the plunger 102, but after the movement of the plunger 102, much time is taken until the air flows into the chamber 106 and a constant pressure is reached. Therefore, From the energizing of the coil to the start of air circulation, a response speed is low. Furthermore, when the solenoid valve 100 is closed, the plunger 102 is pushed into the chamber 106 while pressurizing the air having the constant pressure in the chamber 106, and hence the moving speed of the plunger 102 is low. That is, in the conventional solenoid valve 100, the response speed is low, when the coil 104 is energized and when the energizing is stopped.

Therefore, as in the mail article takeout device of U.S. Pat. No. 5,391,051, when the solenoid valve 100 is used between the suction nozzle and the vacuum tank, the mail articles cannot be taken out at the high speed owing to the above problem of the elimination of the negative pressure, and additionally owing to the low response speed of the solenoid valve 100 itself, the takeout speed is lower.

Moreover, when the solenoid valve 100 is used in the mail article takeout device of U.S. Pat. No. 5,391,051, it is difficult to adsorb a heavy mail article having a relatively large size onto the perforated belt. That is, as shown in FIG. 21, when the solenoid valve 100 is open, its structure requires the circulation of the air through a flow path which is bent plural times, and therefore a passage resistance is large, which makes it difficult to increase the flow rate. In consequence, it is difficult to suck a relatively large amount of the air through the suction nozzle, with the result that the heavy mail article is not easily adsorbed.

BRIEF SUMMARY OF THE INVENTION

An object of this invention is to provide a valve unit capable of circulating and blocking a relatively large amount of flowing subjects at a high response speed.

Moreover, an object of this invention is to provide a paper sheet takeout device capable of easily taking out relatively heavy paper sheets and increasing the takeout speed of the paper sheets.

To achieve the above objects, a valve unit according to an embodiment of this invention is a valve unit which switches an opened state where a first flow path is connected to a second flow path and a closed state where the connection of the first flow path and the second flow path is blocked, and the valve unit comprises a first member having a first facing surface which faces the second flow path, and a first hole provided with one end connected to the first flow path and the other end exposed to the first facing surface; a second member having a second facing surface which faces the first facing surface via a space, and a second hole provided with one end connected to the second flow path and the other end facing the first hole and exposed to the second facing surface; a shield plate disposed in the space movably along the first and second facing surfaces, having a connection hole which connects the first hole to the second hole during moving, and configured to connect the first hole to the second hole and block the connection thereof; and moving means for moving the shield plate between the opened state where the connection hole coincides with the first and second holes and the closed state where the connection of the first and second holes is blocked.

According to the valve unit of the above invention, when the shield plate is moved as much as at least the diameter of the connection hole from the opened state where the connection hole of the shield plate coincides with the first and second holes, the connection of the first and second holes can immediately be blocked to obtain the closed state. Moreover, the shield plate can slightly be moved from the closed state so that the connection hole may coincide with the first and second holes, thereby obtaining the opened state. When the opened state is obtained, the circulation of the large amount of the flowing subjects can immediately be started. In consequence, the response speed is high, and the circulation/block of the relatively large amount of the flowing subjects can immediately be switched. That is, since the flow rate of the flowing subjects by the use of this valve unit depends on the sizes of the first hole, the second hole and the connection hole, the relatively large amount of the flowing subjects can be circulated at once.

Moreover, a paper sheet takeout device according to an embodiment of this invention comprises a throwing section which throws a plurality of paper sheets in a superimposed state; a takeout member having adsorption holes and running along a paper sheet at one end in a superimposing direction among the paper sheets thrown into the throwing section; a negative pressure generating section which sucks the adsorption holes from the backside of this takeout member to generate a negative pressure on the surface of the takeout member, thereby adsorbing the paper sheet at the one end onto the surface of the takeout member; a pump connected to this negative pressure generating section via a suction tube; and a valve unit provided halfway in the suction tube. The valve unit switches an opened state where the suction tube on the upstream side of the valve unit is connected to the suction tube on the downstream side thereof and a closed state where the connection of the upstream suction tube and the downstream suction tube is blocked, and the valve unit includes a first member having a first facing surface which faces the downstream suction tube, and a first hole provided with one end connected to the upstream suction tube and the other end exposed to the first facing surface; a second member having a second facing surface which faces the first facing surface via a space, and a second hole provided with one end connected to the downstream suction tube and the other end facing the first hole and exposed to the second facing surface; a shield plate disposed in the space movably along the first and second facing surfaces, having a connection hole which connects the first hole to the second hole during moving, and configured to connect the first hole to the second hole and block the connection thereof; and moving means for moving the shield plate between the opened state where the connection hole coincides with the first and second holes and the closed state where the connection of the first and second holes is blocked.

According to the above invention, when any paper sheet is not taken out, a large amount of air can immediately be fed into a negative pressure chamber, and the negative pressure chamber can immediately be released to the atmospheric pressure, whereby gaps formed between the paper sheets to be continuously taken out can precisely be controlled, and the takeout speed of the paper sheets can be increased.

Moreover, a paper sheet takeout device according to an embodiment of this invention comprises a throwing section which throws a plurality of paper sheets in a superimposed state; a takeout member having adsorption holes and running along a paper sheet at one end in a superimposing direction among the paper sheets thrown into the throwing section; a negative pressure generating section which sucks the adsorption holes from the backside of this takeout member to generate a negative pressure on the surface of the takeout member, thereby adsorbing the paper sheet at the one end onto the surface of the takeout member; a pump connected to this negative pressure generating section via an exhaust tube; and a valve unit provided halfway in the exhaust tube. The valve unit is a valve unit which switches an opened state where the exhaust tube on the upstream side of the valve unit is connected to the exhaust tube on the downstream side thereof and a closed state where the connection of the upstream exhaust tube and the downstream exhaust tube is blocked, and the valve unit includes a first member having a first facing surface which faces the downstream exhaust tube, and a first hole provided with one end connected to the upstream exhaust tube and the other end exposed to the first facing surface; a second member having a second facing surface which faces the first facing surface via a space, and a second hole provided with one end connected to the downstream exhaust tube and the other end facing the first hole and exposed to the second facing surface; a shield plate disposed in the space movably along the first and second facing surfaces, having a connection hole which connects the first hole to the second hole during moving, and configured to connect the first hole to the second hole and block the connection thereof; and moving means for moving the shield plate between the opened state where the connection hole coincides with the first and second holes and the closed state where the connection of the first and second holes is blocked.

According to the above invention, when any paper sheet is not taken out, a large amount of air can forcedly be fed into the negative pressure chamber, and the negative pressure chamber can immediately be released to the atmospheric pressure, whereby gaps formed between the paper sheets to be continuously taken out can precisely be controlled, and the takeout speed of the paper sheets can further be increased.

Furthermore, a paper sheet takeout device according to an embodiment of this invention comprises a throwing section which throws a plurality of paper sheets in a superimposed state; a takeout member having adsorption holes and running along a paper sheet at one end in a superimposing direction among the paper sheets thrown into the throwing section; a negative pressure generating section which sucks the adsorption holes from the backside of this takeout member to generate a negative pressure on the surface of the takeout member, thereby adsorbing the paper sheet at the one end onto the surface of the takeout member; a pump connected to this negative pressure generating section via a suction tube; an exhaust tube interposed between the negative pressure generating section and the pump; and a single valve unit provided halfway in the suction tube and the exhaust tube. The valve unit is a valve unit which switches a first state where the valve unit is connected to the suction tube and the connection of the valve unit and the exhaust tube is blocked and a second state where the connection of the valve unit and the suction tube is blocked and the valve unit is connected to the exhaust tube, and the valve unit includes a first member having a first facing surface, a first hole provided with one end connected to the suction tube and the other end exposed to the first facing surface, and a second hole provided with one end connected to the exhaust tube and the other end exposed to the first facing surface; a second member having a second facing surface which faces the first facing surface via a space, a third hole provided with one end connected to the suction tube and the other end facing the first hole and exposed to the second facing surface, and a fourth hole provided with one end connected to the exhaust tube and the other end facing the second hole and exposed to the second facing surface; a shield plate disposed in the space movably along the first and second facing surfaces, and having a first connection hole which connects the first hole to the third hole during moving and a second connection hole which connects the second hole to the fourth hole during the moving; and moving means for moving the shield plate between the first state where the first connection hole coincides with the first and third holes and the second state where the second connection hole coincides with the second and fourth holes.

According to the above invention, when any paper sheet is not taken out, the suction of the negative pressure chamber can be stopped. Moreover, a large amount of air can forcedly be fed into the negative pressure chamber, and the negative pressure chamber can more immediately be released to the atmospheric pressure, whereby gaps formed between the paper sheets to be continuously taken out can precisely be controlled, and the takeout speed of the paper sheets can further be increased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of this invention will be described in detail with reference to the drawings.

Figure 1:
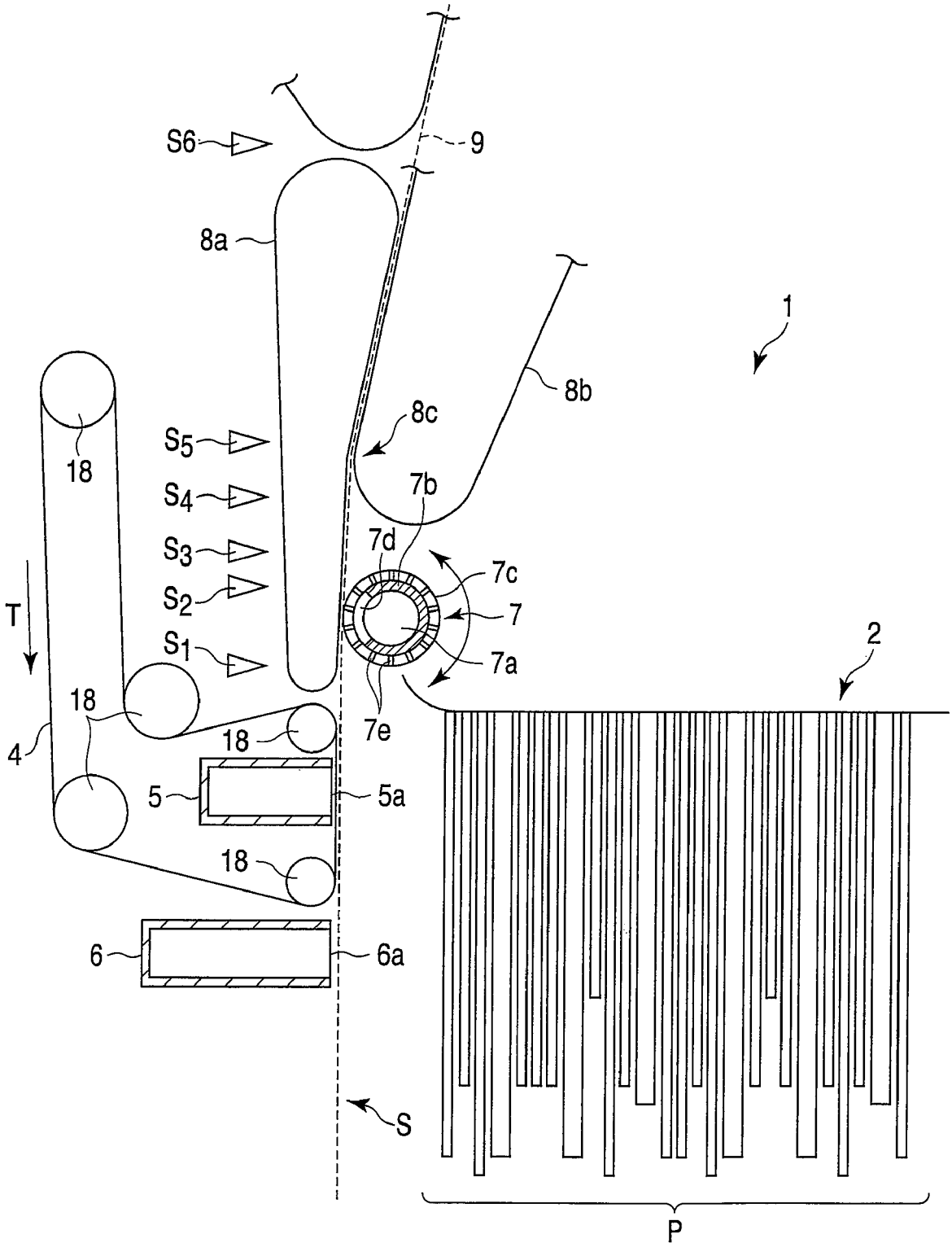
FIG. 1 is a schematic plan view of a paper sheet takeout device according to an embodiment of this invention as seen from the upside thereof.
Figure 2:
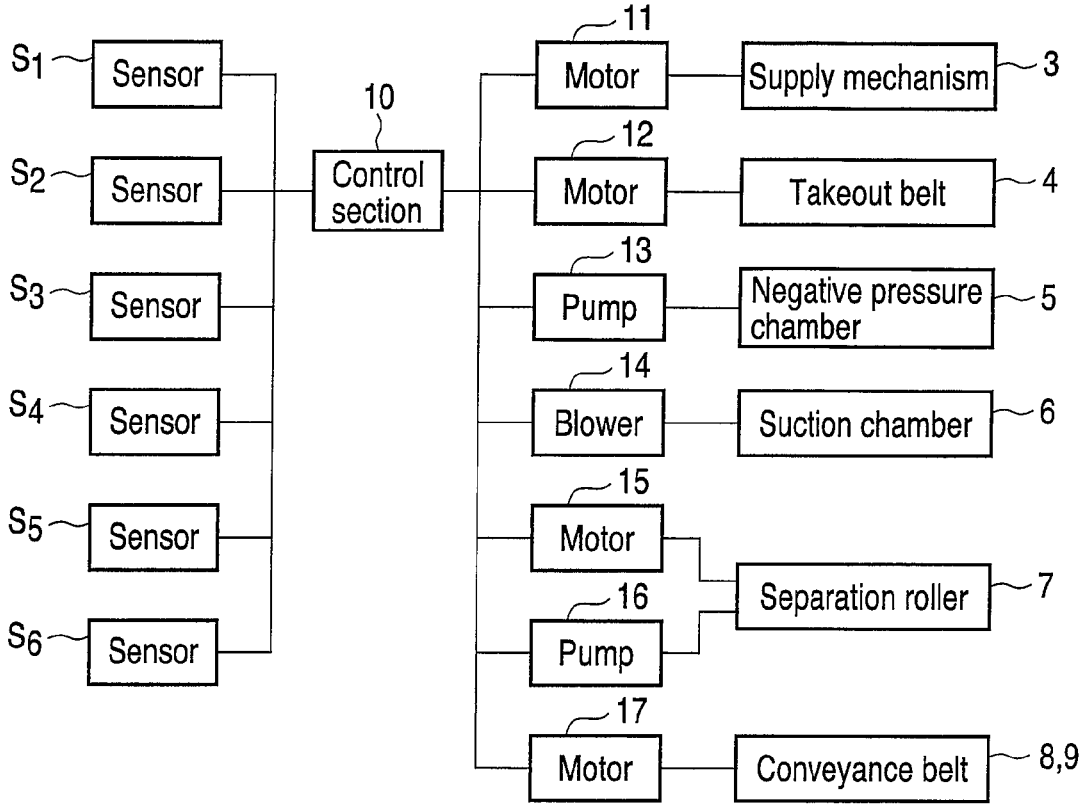
FIG. 2 is a block diagram of a control system which controls the operation of the takeout device of FIG. 1.

FIG. 1 shows a schematic plan view of a paper sheet takeout device 1 (hereinafter referred to simply as the takeout device 1) according to an embodiment of this invention as seen from the upside thereof. Moreover, FIG. 2 shows a block diagram of a control system which controls the operation of the takeout device 1.

The takeout device 1 has a throwing section 2, a supply mechanism 3, a takeout belt 4 (the takeout member), a negative pressure chamber 5 (the negative pressure generating section), a suction chamber 6, a separation roller 7, conveyance belts 8*a*, 8*b*, a plurality of sensors S1 to S6, a control section 10 which controls the operation of the whole device and the like.

The control section 10 is connected to the plurality of sensors S1 to S6, a motor 11 for operating a floor belt or a backup plate (not shown) of the supply mechanism 3, a motor 12 for running the takeout belt 4 in an arrow T direction, a pump 13 for evacuating the negative pressure chamber 5, a blower 14 for sucking the suction chamber 6, a motor 15 for imparting a separation torque to the separation roller 7, a pump 16 for generating a negative pressure on the peripheral surface of the separation roller 7, and a motor 17 for running the conveyance belts 8*a*, 8*b*.

Into the throwing section 2, a plurality of accumulated paper sheets P are vertically thrown. The paper sheets P thrown into the throwing section 2 are moved to one end of the accumulating direction of the paper sheets (on the left side in FIG. 1) by the supply mechanism 3, and the paper sheet P at the one end of the accumulating direction (at the left end in FIG. 1) is supplied to a takeout position S. The supply mechanism 3 operates, every time the paper sheet P supplied to the takeout position S is taken out, and constantly supplies the paper sheet P present at the one end of the accumulating direction to the takeout position S.

The takeout belt 4 is wound around a plurality of pulleys 18 and extended endlessly. A part of the takeout belt 4 comes in contact with the paper sheet P supplied to the takeout position S, and runs at a constant speed in the planar direction of the paper sheet P, that is, in a takeout direction T (the upside of FIG. 1). The negative pressure chamber 5 is disposed in a position facing the takeout position S via the takeout belt 4 on the inner side of this takeout belt 4.

Figure 3:
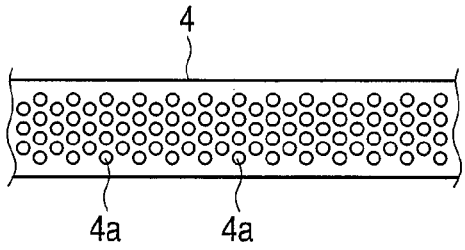
FIG. 3 is a partially enlarged view partially showing a takeout belt incorporated in the takeout device of FIG. 1.

As shown in FIG. 3, the takeout belt 4 is provided with a plurality of adsorption holes 4*a*. On the other hand, the negative pressure chamber 5 has an opening 5*a* facing the back surface of the takeout belt 4. Therefore, when the takeout belt 4 is run to evacuate the negative pressure chamber 5, the pressure of the negative pressure chamber 5 is decreased, and a negative pressure acts on the paper sheet P in the takeout position S through the opening 5*a* of the negative pressure chamber 5 and the adsorption holes 4*a* of the takeout belt 4, to adsorb the paper sheet P onto the surface of the takeout belt 4. The paper sheet P adsorbed onto the takeout belt 4 is taken out of the takeout position S by running the belt 4.

The paper sheet P taken out of the takeout position S is conveyed to the upside of FIG. 1 through a conveyance path 9, and is transferred to a conveyance section 8. The plurality of sensors S1 to S6 provided along the conveyance path 9 are transmitting type (one side is not shown) optical sensors, detect that the connection of the optical paths of the sensors is blocked by the paper sheets P (a sensor output; dark), and detect that any paper sheet P is not present along the optical paths (a sensor output; bright). That is, each of the sensors S1 to S6 detects the passage of the tips and rear ends of the paper sheets P in a conveyance direction thereof, respectively.

The suction chamber 6 has an opening 6*a* disposed to face the takeout position S on the upstream side of the takeout belt 4 (the downside in the drawing) along the takeout direction of the paper sheets P. Therefore, when the blower 14 is operated, air is sucked from the opening 6*a* of the suction chamber 6, and an air flow is generated in the takeout position S. This air flow functions to immediately suck, to the takeout position S, the paper sheet P at the one end of the accumulating direction among the plurality of paper sheet thrown into the throwing section 2.

The separation roller 7 is disposed on a side opposite to the takeout belt 4 via the conveyance path 9 on the downstream side of the takeout position S in the takeout direction. The separation roller 7 has a substantially cylindrical core 7*b* having a chamber 7*a* therein, and a substantially cylindrical sleeve 7*c* rotatably provided around the outer periphery of this core 7*b*. The core 7*b* is fixedly attached while an opening 7*d* is directed to the conveyance path 9. The sleeve 7*c* has a plurality of adsorption holes 7*e*. Therefore, when the pump 16 is operated to evacuate the chamber 7*a* of the core 7*b*, the pressure of the chamber 7*a* is decreased to generate the negative pressure on the peripheral surface of the separation roller 7 through the plurality of adsorption holes 7*e* of the sleeve 7*c* rotated around the outer periphery of the core 7*b*.

That is, the motor 15 imparts, to the sleeve 7*c*, the separation torque having a direction reverse to the takeout direction, and the pump 16 generates the negative pressure on the outer peripheral surface of the sleeve 7*c*, whereby the second and subsequent paper sheets P taken out together with the first paper sheet P taken out of the takeout position S can be separated.

Moreover, on a side facing the separation roller 7 (the left side in the drawing) via the conveyance path 9, the endless conveyance belt 8*a* is disposed. On the other hand, also in a position facing the conveyance belt 8*a* via the conveyance path 9, the endless conveyance belt 8*b* is disposed. That is, the conveyance path 9 on the downstream side of the separation roller 7 is defined between the two conveyance belts 8*a* and 8*b*. In consequence, the tip of the paper sheet P taken out of the takeout position S by the takeout belt 4 in the takeout direction is held in a nip 8*c* between the conveyance belts 8*a* and 8*b*, transferred to the conveyance belts 8*a*, 8*b* (a conveyance section) and conveyed to the downstream side.

Here, there will be described an operation for discharging the plurality of paper sheets P thrown into the throwing section 2 onto the conveyance path 9 one by one.

When the plurality of paper sheets P are thrown into the takeout device 1 through the throwing section 2, the supply mechanism 3 successively supplies the paper sheets P to the takeout position S, and the paper sheets are adsorbed onto the takeout belt 4 and discharged onto the conveyance path 9. The control section 10 monitors the conveyance positions and conveyance states of the paper sheets P conveyed through the conveyance path 9 by the plurality of sensors S1 to S6.

When the paper sheets P are taken out, the pump 13 evacuates the negative pressure chamber 5 to decrease a pressure in the negative pressure chamber 5, and this decreased pressure generates the negative pressure on the surface of the takeout belt 4. Moreover, the paper sheet P at the one end of the accumulating direction among the paper sheets P thrown into the throwing section 2 is provided with the air flow constantly directed to the takeout position S by the suction chamber 6. That is, the paper sheet P at the one end of the accumulating direction is immediately attracted to the takeout position S by the suction chamber 6, adsorbed onto the takeout belt 4 and taken out.

The paper sheet P taken out of the takeout position S protrudes into the nip 8*c* between the conveyance belts 8*a* and 8*b*, and the tip of the paper sheet in the takeout direction is held in the nip 8*c* and further conveyed to the downstream side. It is detected that the taken paper sheet P has reached the nip 8*c*, when the output of the sensor S5 changes from a bright state to a dark state. At this time, the run speed of the conveyance belts 8*a*, 8*b* is set to a speed slightly higher than that of the takeout belt 4, and the paper sheet P is drawn out and conveyed by the conveyance belts 8*a*, 8*b*.

When the second and subsequent paper sheets P superimposed on the first paper sheet P forwarded from the takeout position S are taken out together, the second and subsequent paper sheets P are separated by the separation roller 7. At this time, the negative pressure is generated on the peripheral surface of the separation roller 7, and the separation torque having a direction reverse to the takeout direction is imparted to the sleeve 7*c*. When the one paper sheet P is normally taken out, the sleeve 7*c* of the separation roller 7 is rotated along the takeout direction. When two superimposed paper sheets are taken out, the sleeve 7*c* rotates in reverse. In consequence, the second and subsequent paper sheets P are returned in the reverse direction and separated from the first paper sheet P.

Meanwhile, when the plurality of superimposed paper sheets P are separated and discharged onto the conveyance path 9 one by one as described above, the negative pressure of the negative pressure chamber 5 is ON/OFF-controlled, or the takeout belt 4 is intermittently run, to form a gap between the paper sheets P. The size of each gap is determined in accordance with the treatment ability of the paper sheets P in a treatment device (here the drawing and description thereof are omitted) connected to the conveyance path 9 on the downstream side of the takeout device 1, and/or the size of the gap is determined in accordance with the switch speed of a gate (not shown) disposed on the downstream side of the conveyance path 9.

For example, to increase a treatment efficiency in the treatment device on the downstream side and to give a sufficient treatment time, the gap between the paper sheets P is preferably stably controlled into a desired length. However, in the method of intermittently operating the takeout belt 4 to form the gap, it is difficult to precisely control a time required for the acceleration and deceleration of the belt, and slippage might be generated between the belt and the paper sheet P during the acceleration/deceleration.

On the other hand, to ON/OFF-control the negative pressure of the negative pressure chamber 5, there is considered a method of providing the above-mentioned conventional solenoid valve halfway in a pipe connecting the pump 13 to the negative pressure chamber 5, and controlling the opening/closing of the solenoid valve to control the gap between the paper sheets. However, in this method, the response speed of the solenoid valve itself is low as described above. Additionally, even in a case where the solenoid valve is closed to stop the suction by the pump 13, while the paper sheet P is adsorbed onto the belt, the negative pressure in the negative pressure chamber 5 remains for a while, and hence much time is required for recovering the atmospheric pressure.

Consequently, in either method, it is difficult to control the gap between the paper sheets P into the desired length.

On the other hand, the present inventors have found a method of attaching a pressure regulation device to the negative pressure chamber 5 to immediately release the negative pressure in the negative pressure chamber 5 to the atmospheric pressure at a desired timing, and precisely controlling the gap between the paper sheets P into the desired length. Hereinafter, the pressure regulation device according to several embodiments of the present invention will be described.

Figure 4:
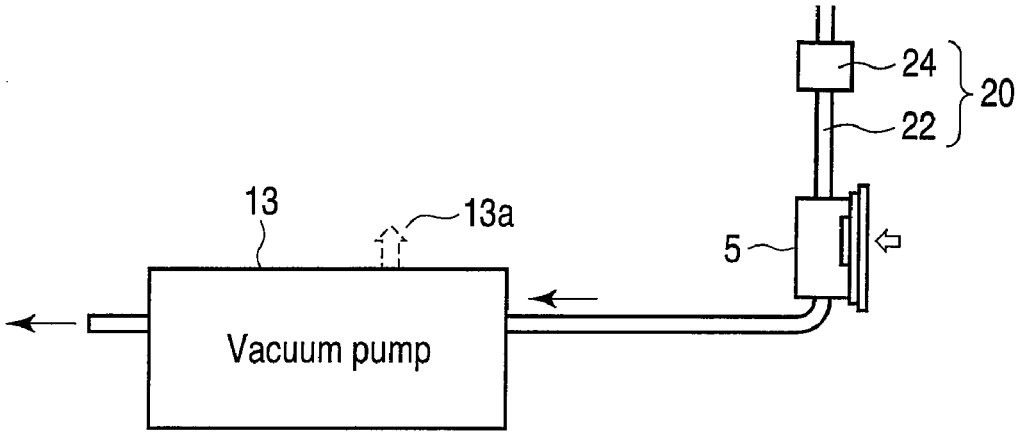
FIG. 4 is a schematic diagram of a main portion showing a takeout device including a pressure regulation device according to a first embodiment of this invention.

FIG. 4 schematically shows the structure of a main portion of the takeout device 1 including a pressure regulation device 20 according to the first embodiment of this invention. This pressure regulation device 20 has a tube 22 for feeding air into the negative pressure chamber 5 and a valve unit 24 provided halfway in this tube 22. This valve unit 24 is controlled to open or close by the control section 10.

That is, in the present embodiment, on the assumption that the pump 13 is constantly operated to constantly evacuate the negative pressure chamber 5, the valve unit 24 is opened at a timing when the paper sheet P is not adsorbed onto the takeout belt 4. By using the valve unit 24 of the present embodiment, a large amount of air can immediately flow into the negative pressure chamber 5 evacuated by the pump 13, through the tube 22, and the negative pressure chamber 5 can immediately be released to the atmospheric pressure.

In this case, since the negative pressure chamber 5 is constantly evacuated, to eliminate the negative pressure in the chamber 5, a large amount of air needs to be fed into the negative pressure chamber 5 all together. However, during conventional control for simply turning off the solenoid valve, the large amount of the air is not fed into the chamber 5 all together, and hence much time is required for eliminating the negative pressure. In consequence, to precisely control the gap between the paper sheets P into a desired value, it is important to feed the large amount of the air into the negative pressure chamber 5 all together when any paper sheet is not adsorbed.

Figure 5:
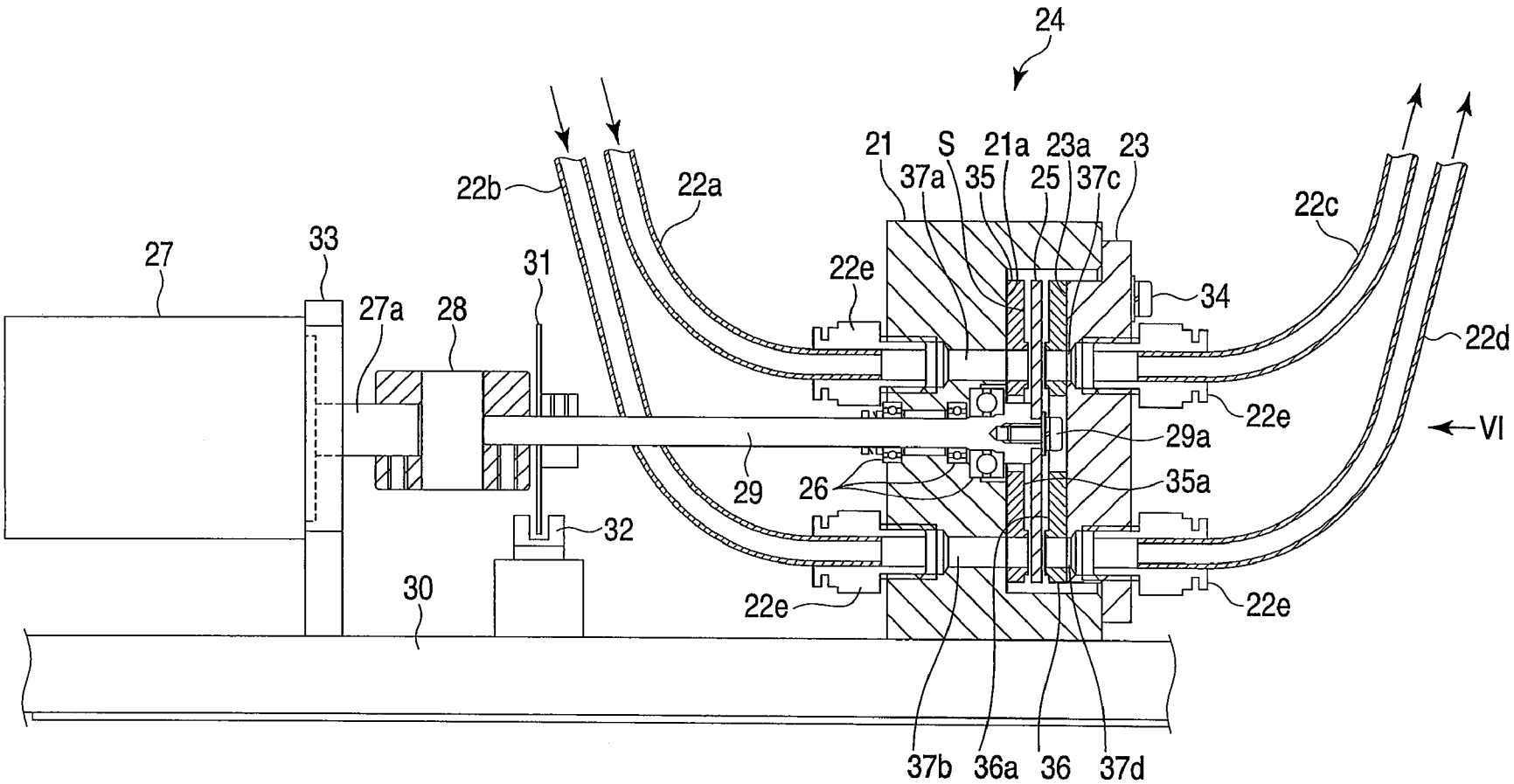
FIG. 5 is a sectional view showing a valve unit of the pressure regulation device of FIG. 4.
Figure 6:
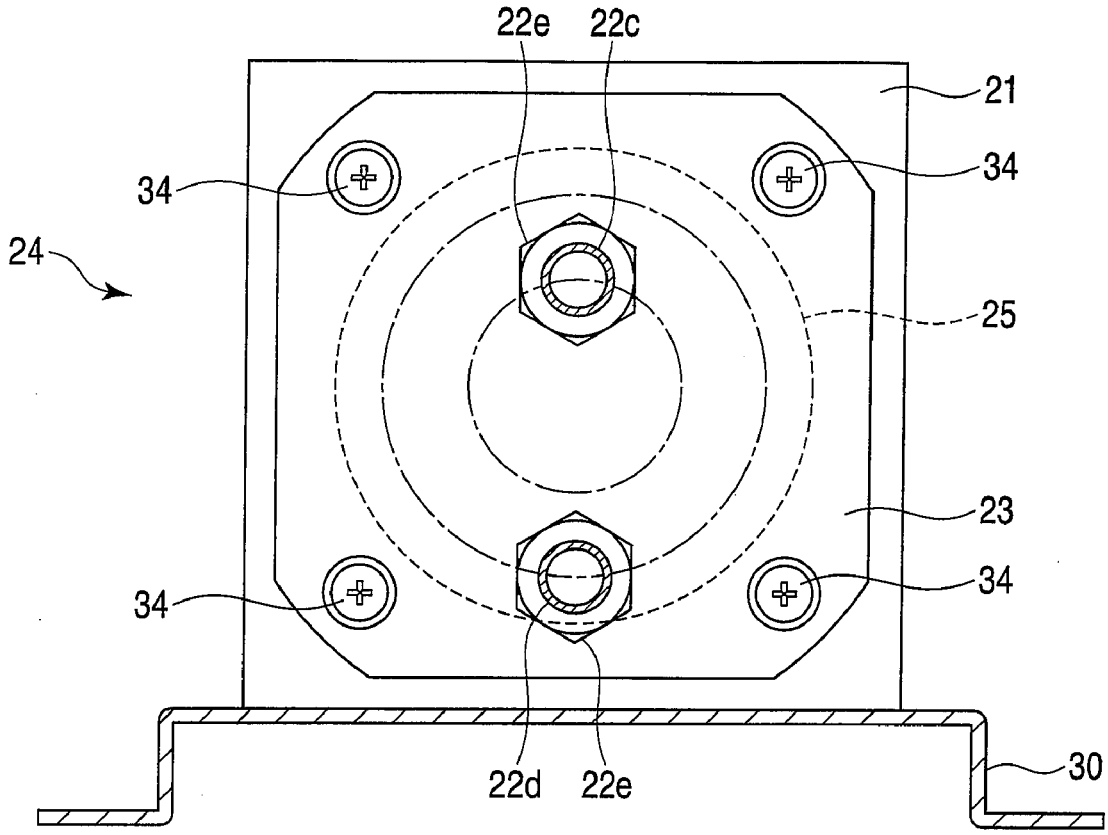
FIG. 6 is a schematic diagram of the valve unit of FIG. 5 as seen from an arrow VI direction.
Figure 7:
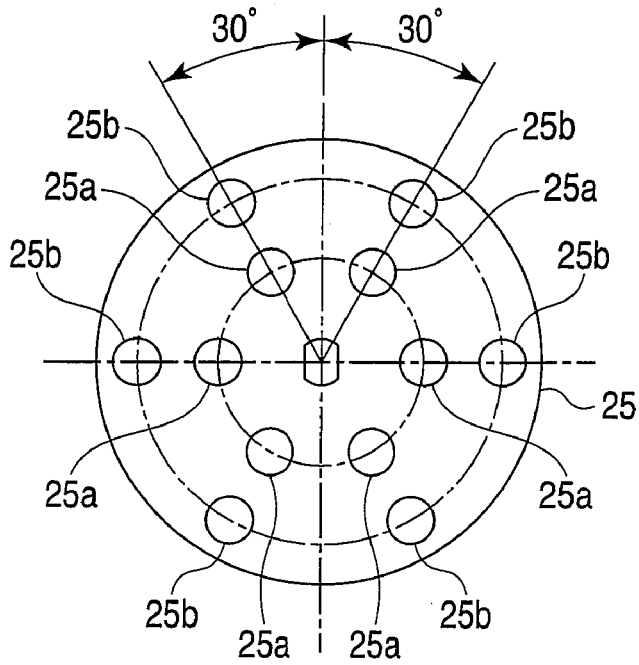
FIG. 7 is a schematic diagram showing a shield plate incorporated in the valve unit of FIG. 5.

FIG. 5 shows a sectional view of the valve unit 24 according to the first embodiment of this invention. Moreover, FIG. 6 shows a schematic diagram of the valve unit 24 of FIG. 5 as seen from an arrow VI direction. Furthermore, FIG. 7 shows a schematic diagram of a shield plate 25 incorporated in the valve unit 24 of FIG. 5.

This valve unit 24 is connected to two upstream tubes 22*a*, 22*b* (a first flow path) and two downstream tubes 22*c*, 22*d* (a second flow path). In other words, these four tubes 22*a*, 22*b*, 22*c* and 22*d* correspond to the tube 22 of FIG. 4, and one valve unit 24 is provided halfway in the plurality of tubes.

The valve unit 24 has a substantially rectangular first block 21 (a first member), a second block 23 (a second member) facing this first block, the substantially circular shield plate 25 rotatably disposed in a space S formed between the first block 21 and the second block 23, and a motor 27 (moving means) for rotating this shield plate 25.

A rotary shaft 27*a* of the motor 27 is coaxially connected to a driving shaft 29 of the shield plate 25 via a coupling 28. The driving shaft 29 extends through the first block 21, and is rotatably attached to the first block 21 via a plurality of bearings 26. The shield plate 25 is fixed to the tip of the driving shaft 29 by using a screw 29*a*.

Moreover, the driving shaft 29 of the shield plate 25 is fixedly provided with a reference phase detection plate 31, and a detection sensor 32 for detecting a cutout (not shown) formed in the outer peripheral edge of this reference phase detection plate 31 during the rotation of the reference phase detection plate 31 is fixed to a base 30. Additionally, the first block 21 is fixed to the base 30, and the motor 27 is additionally fixed to the base via a bracket 33. It is to be noted that this reference phase detection plate 31 has a cutout in a position which can be provided with a detection reference for detecting the position of a connection hole provided in the shield plate 25 as described later. In consequence, the control section 10 rotates and stops the motor 27 based on a detection result obtained by the detection sensor 32 to dispose the shield plate 25 in a desired phase.

The upstream tubes 22*a*, 22*b* are connected to the back surface of the first block 21 via pipe couplings 22*e*, respectively, and the downstream tubes 22*c*, 22*d* are connected to the back surface of the second block 23 via pipe couplings 22*e*, respectively. More specifically, the tubes 22*a*, 22*b*, 22*c* and 22*d* are positioned and arranged so that the one upstream tube 22*a* faces the one downstream tube 22*c* with a substantially coaxial relation and so that the other upstream tub 22*b* faces the other downstream tube 22*d* with a substantially coaxial relation. In this state, the second block 23 is fastened, fixed and positioned to the first block 21 by a plurality of bolts 34.

The first block 21 has a facing surface 21*a* which faces the second block 23 (i.e., the downstream tubes 22*c*, 22*d*), and the second block 23 has a facing surface 23*a* which faces the first block 21 (i.e., the upstream tubes 22*a*, 22*b*). These facing surfaces 21*a*, 23*a* are formed into a circle which is one size larger than the shield plate 25, and face each other in parallel.

Moreover, to the facing surface 21*a* of the first block 21, a shield member 35 having a diameter substantially equal to that of the shield plate 25 is attached, and also to the facing surface 23*a* of the second block 23, a shield member 36 having a diameter substantially equal to that of the shield plate 25 is attached. Between the shield member 35 attached to the facing surface 21*a* of the first block 21 and the shield member 36 attached to the facing surface 23*a* of the second block 23, a space S for receiving the rotatable shield plate 25 is formed. In other words, the space S is formed between the facing surface 21*a* and the facing surface 23*a*. The shield plate 25 rotates in this space S.

The first block 21 is provided with two elongated holes 37*a*, 37*b* (first holes) each having one end connected to each of the upstream tubes 22*a*, 22*b*. Each of the elongated holes 37*a*, 37*b* also extends through the shield member 35 attached to the facing surface 21*a* of the first block 21, and has the other end exposed to the space S.

Moreover, the second block 23 is also provided with two elongated holes 37*c*, 37*d* (second holes) each having one end connected to each of the downstream tubes 22*c*, 22*d*. Each of the elongated holes 37*c*, 37*d* also extends through the shield member 36 attached to the facing surface 23*a* of the second block 23, and has the other end exposed to the space S. Moreover, the elongated hole 37*a* substantially coaxially faces the elongated hole 37*c*, and the elongated hole 37*b* substantially coaxially faces the elongated hole 37*d*.

A distance between facing surfaces 35*a* and 36*a* of the shield members 35 and 36 facing the space S is set to a value slightly larger than the thickness of the shield plate 25, but the distance between the shield members 35 and 36 is shortened in a portion where the other end of each of the elongated holes 37*a*, 37*b*, 37*c* and 37*d* is exposed. That is, the peripheral edge of the other end of the elongated hole of each of the shield members 35, 36 slightly protrudes in an annular shape toward the space S so as to decrease air leaking from the gap S as much as possible, while the other end of the elongated hole 37*a* (37*b*) and the other end of the elongated hole 37*c* (37*d*) are closed with the shield plate 25.

In consequence, the amount of the air leaking from the space S can be decreased, but the rotation of the shield plate 25 is allowed, and hence the shield plate 25 is not necessarily closely attached to the two shield members 35, 36. In other words, the valve unit 24 of the present embodiment does not have to seal a flow path so that the air is not released. Even when the air slightly leaks, any problem does not occur, and the application of the valve unit is limited to such an application as to allow the leakage of the air.

As shown in FIG. 7, the shield plate 25 is provided with a plurality of connection holes 25*a*, 25*b* extending through the shield plate 25. In the present embodiment, all the connection holes 25*a*, 25*b* are formed into a circular shape having a diameter substantially equal to the inner diameter of each of the tubes 22*a*, 22*b*, 22*c* and 22*d*. The shape of the connection holes 25*a*, 25*b* is not limited to the circular shape, but the tube 22 usually has a cylindrical shape, and hence in the present embodiment, the connection holes have the same circular shape as that of the tube 22 in order to decrease an air resistance as much as possible.

In the present embodiment, the connection holes 25*a*, 25*b* are formed in positions shown in FIG. 7. That is, six connection holes 25*a* are arranged at an equal interval along a relatively small circumference close to the center of the shield plate 25, and six connection holes 25*b* are arranged at an equal interval along a relatively large circumference away from the center of the shield plate. In the present embodiment, each of the six inner connection holes 25*a* and each of the six outer connection holes 25*b* are arranged along the same radius.

During the rotation of the shield plate 25, each of the six inner connection holes 25*a* is disposed in such a position as to coincide with the elongated hole 37*a* of the first block 21 and the elongated hole 37*c* of the second block 23 and to connect the upstream tube 22*a* to the downstream tube 22*c*. Moreover, during the rotation of the shield plate 25, each of the six outer connection holes 25*b* is disposed in such a position as to coincide with the elongated hole 37*b* of the first block 23 and to connect the upstream tube 22*b* to the downstream tube 22*d*.

For example, in a case where the motor 27 is controlled and rotated by the control section 10 and the shield plate 25 is rotated and stopped in a position where one inner connection hole 25*a* coincides with the inner elongated holes 37*a*, 37*c*, the outer connection hole 25*b* disposed along the same radius does not coincide, but the outer connection hole 25*b* disposed in a position symmetric with respect to the center of the shield plate 25 coincides with the outer elongated holes 37*b*, 37*d*. This relation appears every time the shield plate 25 is rotated as much as 60°, and the valve unit 24 can be opened six times during one rotation. In other words, the valve unit 24 of the present embodiment can alternately open and close repeatedly, when the shield plate 25 is intermittently rotated as much as 30°.

Thus, one flow path is disposed on the inner side of the rotation, and the other flow path is disposed on the outer side of the rotation, whereby more connection holes 25*a*, 25*b* can be formed in the shield plate 25, and the valve unit 24 can be opened in more rotating positions (six positions in the present embodiment). The amount of the shield plate 25 to be rotated between the opened state and the closed state can be decreased, and the response speed of the valve unit 24 can be increased. Moreover, the two flow paths are thus controlled to open or close simultaneously, whereby the flow rate in the opened state can be increased. In this case, the inertia of the shield plate 25 does not increase, and the response speed is not delayed in accordance with the number of the flow paths.

Here, the opening/closing control of the valve unit 24 having the above structure will be described.

When the tip of the paper sheet P adsorbed onto the takeout belt 4 and discharged onto the conveyance path 9 in a conveyance direction reaches the sensor S5 (FIG. 1), the control section 10 judges that the paper sheet P is transferred to the nip 8*c* between the conveyance belts 8*a* and 8*b*, and opens the valve unit 24. Alternatively, the control section 10 opens the valve unit 24 at a timing when one of the sensors S1 to S5 arranged on the conveyance path 9 detects the passage of the rear end of the paper sheet P in the conveyance direction. That is, at this time, the shield plate 25 is rotated and stopped in a position where the connection holes 25*a*, 25*b* of the shield plate 25 are connected to the tubes 22*a*, 22*b*, 22*c* and 22*d*. In the following description, this timing will be referred to the first timing.

In consequence, the large amount of the air can be fed into the negative pressure chamber 5 through the tube 22 all together, and the first paper sheet P can be held and bound by the nip 8*c* between the conveyance belts 8*a* and 8*b*, and can securely be conveyed to the downstream side. Moreover, it is possible to prevent a defect that the second and subsequent paper sheets P are adsorbed onto the takeout belt 4, and two paper sheets P can be prevented from being taken out together.

Then, the control section 10 is triggered by detecting a gap between the first paper sheet P and the second paper sheet P, closes the valve unit 24, takes out and adsorbs the second paper sheet P onto the takeout belt 4, and starts taking out the second paper sheet P. That is, at this time, the shield plate 25 is rotated and stopped in a position where the connection holes 25*a*, 25*b* of the shield plate 25 do not coincide with the tubes 22*a*, 22*b*, 22*c* and 22*d*. In the following description, this timing will be referred to as the second timing.

In consequence, the tube 22 is closed, the negative pressure chamber 5 is again evacuated, and the second paper sheet P is adsorbed onto the belt 4. At this time, the timing to close the valve unit 24 can be regulated to control the gap. That is, when the timing to close the valve unit 24 is delayed, the gap enlarges. When the timing to close the valve unit 24 is advanced, the gap becomes small. It is to be noted that the gap between the first paper sheet P and the second paper sheet P is detected by judging that the output of one of the sensors S1 to S4 becomes bright.

As described above, according to the present embodiment, the valve unit 24 is opened at the first timing when any paper sheet P is not adsorbed, whereby the large amount of air is immediately fed into the negative pressure chamber 5 through the tube 22. Therefore, the negative pressure of the negative pressure chamber 5 can immediately be eliminated at a desired timing, and the gap between the paper sheets P can precisely be controlled into the desired length. Moreover, the takeout period of the paper sheets P can be accelerated, and the paper sheets P can be taken out at a high speed.

In particular, when the valve unit 24 of the present embodiment is used, two flow paths can simultaneously be opened or closed, and the large amount of the air can be fed into the negative pressure chamber 5 for a short time. Moreover, according to the valve unit 24 of the present embodiment, the number of pipes connected to the valve unit 24 and the positions and number of the connection holes of the shield plate 25 can easily be changed, whereby three or more flow paths can simultaneously be opened or closed. Also in this case, the device is not enlarged. Alternatively, when the diameters of the pipes and the diameters of the connection holes are increased, the flow path itself can easily be thickened, and the flow rate of the air can easily be increased.

On the other hand, in a case where the conventional solenoid valve is used for the same application, when a plurality of flow paths are controlled to open or close, each flow path needs to be provided with one solenoid valve, and a device constitution becomes complicated, whereby the device is enlarged, and cost increases. Moreover, in the solenoid valve, as described above, the passage resistance of a flowing subject is large, and it is difficult to pass the large amount of the air all together, whereby the negative pressure chamber 5 cannot immediately be returned to the atmospheric pressure. Moreover, when a plurality of solenoid valves are used, all the solenoid valves need to be simultaneously controlled to open or close, and the control becomes complicated. Furthermore, when the flow path itself is thick, the inertia of the plunger accordingly increases, and the response speed of the solenoid valve delays.

On the other hand, in the valve unit 24 of the present embodiment, the plurality of flow paths can simultaneously be controlled to open or close by simple control, for example, simply by rotating the motor 27. The number of the flow paths simultaneously controllable to open or close can be set to an arbitrary number, the thickness of each flow path can be set to an arbitrary thickness, and only one valve may be used. Moreover, the valve unit 24 of the present embodiment has a structure through which the air can linearly pass, whereby the air hardly has the passage resistance, and the large amount of the air can be circulated.

It is to be noted that in the present embodiment, the pump 13 is constantly operated, and the negative pressure chamber 5 is constantly evacuated. However, the pump 13 is provided with a release valve 13*a* (FIG. 4) so that the air pressure in the negative pressure chamber 5 does not lower below a constant value, whereby even when the pump 13 is constantly operated, the air pressure in the negative pressure chamber 5 does not continue to lower.

Figure 8:
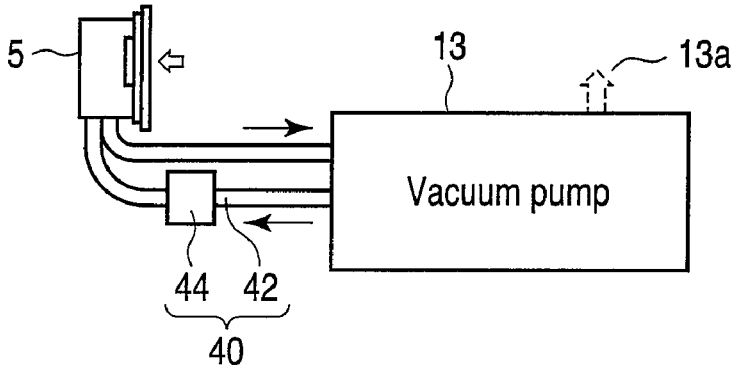
FIG. 8 is a schematic diagram of a main portion showing a takeout device including a pressure regulation device according to a second embodiment of this invention.

FIG. 8 schematically shows the structure of a main portion of a takeout device 1 including a pressure regulation device 40 according to a second embodiment of this invention. The takeout device 1 including the pressure regulation device 40 of the present embodiment also has the same basic structure as that of the takeout device 1 including the above pressure regulation device 20, and also performs the same basic operation, and hence the description of the same part is omitted.

Instead of the tube 22 and the valve unit 24 of the first embodiment, the pressure regulation device 40 of the present embodiment has an exhaust tube 42 which connects an exhaust port of a pump 13 for evacuating a negative pressure chamber 5 to the negative pressure chamber 5, and the valve unit 44 attached to the middle of this exhaust tube 42. This pressure regulation device 40 is different from the pressure regulation device 20 of the first embodiment in that an exhaust gas from the pump 13 is positively fed into the negative pressure chamber 5.

That is, in the above first embodiment, when the negative pressure in the negative pressure chamber 5 is eliminated, the valve 24 is opened to cause the air to naturally flow into the chamber 5, whereby the pressure in the chamber 5 is brought close to the atmospheric pressure. However, in the present embodiment, when the negative pressure is eliminated, the air is positively fed into the chamber 5, and the air pressure in the chamber 5 can be brought close to the atmospheric pressure for a shorter time.

It is to be noted that the valve unit 44 has the same structure as that of the valve unit 24 of the first embodiment. In the first embodiment, the valve unit 24 is provided halfway in the tube 22, whereas in the present embodiment, the valve unit 44 is only provided halfway in the exhaust tube 42.

That is, in the present embodiment, the control section 10 controls the opening/closing of the valve unit 44 at the same timing as in the valve unit 24 of the first embodiment. However, when the valve unit 44 is opened at the first timing, the air is more positively fed into the negative pressure chamber 5, whereby the air pressure in the negative pressure chamber 5 can more immediately be brought close to the atmospheric pressure as compared with the first embodiment. In consequence, a gap between paper sheets P can more precisely be controlled as compared with the first embodiment.

Figure 9:
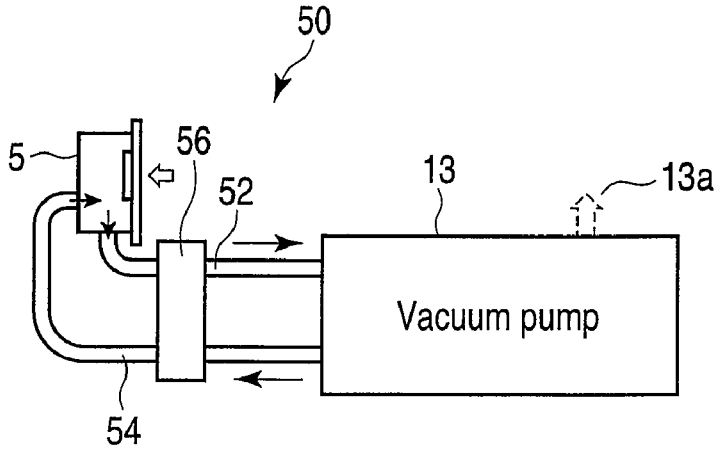
FIG. 9 is a schematic diagram of a main portion showing a takeout device including a pressure regulation device according to a third embodiment of this invention.

FIG. 9 shows the structure of a main portion of a takeout device 1 including a pressure regulation device 50 according to a third embodiment of this invention. In the present embodiment, one common valve unit 56 is provided halfway in a suction tube 52 which connects a suction port of a pump 13 to a negative pressure chamber 5 and an exhaust tube 54 which connects an exhaust port of the pump 13 to the negative pressure chamber 5. This valve unit 56 substantially has the same structure as in the valve units 24, 44 of the first and second embodiments, but is different therefrom in the positions of connection holes formed in a shield plate and the circulating direction of air flowing through two flow paths.

Figure 10:
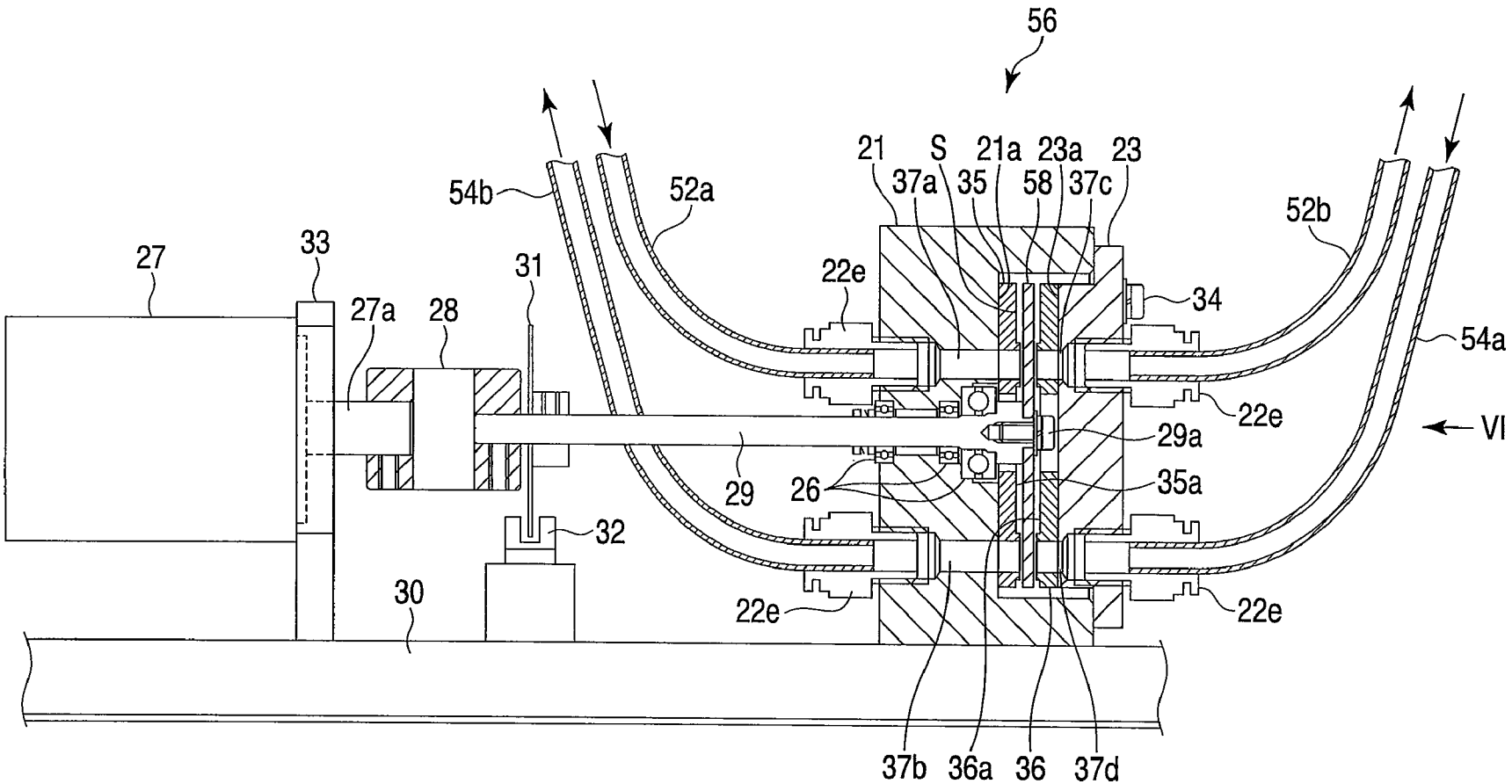
FIG. 10 is a sectional view showing a valve unit of the pressure regulation device of FIG. 9.
Figure 11:
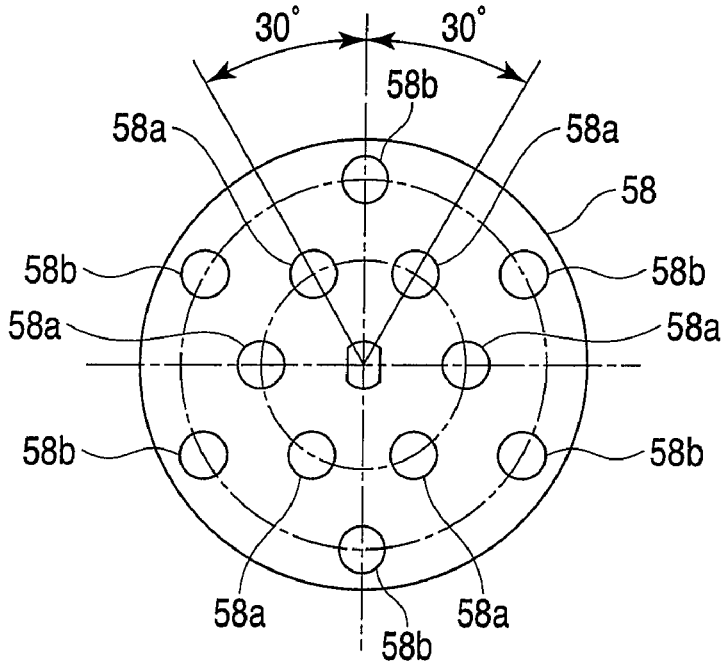
FIG. 11 is a schematic diagram showing a shield plate incorporated in the valve unit of FIG. 10.

FIG. 10 shows a sectional view of this valve unit 56, and FIG. 11 shows a schematic diagram of a shield plate 58 incorporated in this valve unit 56. The valve unit 56 of FIG. 10 has substantially the same structure as that of the valve unit 24 of FIG. 5, except the structure of the shield plate 58 and the circulating direction of air. Therefore, constituent elements which similarly function are denoted with the same reference numerals, and the detailed description thereof is omitted.

The shield plate 58 of the present embodiment has a plurality of connection holes 58*a*, 58*b* in positions shown in FIG. 11. That is, six connection holes 58*a* are arranged at an equal interval along a relatively small circumference close to the center of the shield plate 58, and six connection holes 58*b* are arranged at an equal interval along a relatively large circumference away from the center of the shield plate. In the present embodiment, the plurality of connection holes 58*a*, 58*b* are positioned and arranged with a mutual phase difference of 30° so that the six inner connection holes 58*a* and the six outer connection holes 58*b* are not arranged along the same radius.

During the rotation of the shield plate 58, each of the six inner connection holes 58*a* is disposed in such a position as to coincide with an elongated hole 37*a* of a first block 21 and an elongated hole 37*c* of a second block 23 and to connect an upstream suction tube 52*a* to a downstream suction tube 52*b*. Moreover, during the rotation of the shield plate 58, each of the six outer connection holes 58*b* is disposed in such a position as to coincide with an elongated hole 37*b* of the first block 21 and an elongated hole 37*d* of the second block 23 and to connect an upstream exhaust tube 54*a* to a downstream exhaust tube 54*b*.

For example, in a case where a motor 27 is controlled and rotated by a control section 10 and the shield plate 58 is rotated and stopped in a position where one inner connection hole 58*a* coincides with the inner elongated holes 37*a*, 37*c*, the outer elongated holes 37*b*, 37*d* are closed by the shield plate 58 to evacuate a negative pressure chamber 5. That is, when the shield plate 58 is rotated to this angular position, a suction tube 52 is opened, and an exhaust tube 54 is closed.

When the shield plate 58 is rotated from this state by the motor 27 as much as 30°, one of the outer connection holes 58*b* coincides with the outer elongated holes 37*b*, 37*d* to connect the upstream exhaust tube 54*a* to the downstream exhaust tube 54*b*, and the connection of the inner elongated holes 37*a*, 37*c* is blocked. In this state, the suction of the negative pressure chamber 5 is discontinued to feed an exhaust gas from a vacuum pump 13 into the negative pressure chamber 5, and an air pressure in the negative pressure chamber 5 is immediately returned to the atmospheric pressure.

That is, in a case where the valve unit 56 of the present embodiment is used, while the suction tube 52 is connected to the valve unit, the connection of the valve unit and the exhaust tube 54 is blocked. While the exhaust tube 54 is connected to the valve unit, the connection of the valve unit and the suction tube 52 is blocked. Specifically, the control section 10 of a takeout device 1 controls the opening/closing of the valve unit 56 of the present embodiment as follows.

That is, when paper sheets P are taken out, the control section 10 rotates the shield plate 58 to a position where the connection of the exhaust tube 54 is blocked and the suction tube 52 is connected, evacuates the negative pressure chamber 5, adsorbs the paper sheet P onto a takeout belt 4, and discharges the paper sheet onto a conveyance path 9. Also in the present embodiment, the vacuum pump 13 is constantly sucked.

Then, at a first timing when the tip of the taken paper sheet P in a conveyance direction reaches a nip 8*c* of a conveyance section 8*b*, the control section 10 rotates the shield plate 58 to a position where the exhaust tube 54 is connected and the connection of the suction tube 52 is blocked, and forcedly feeds air into the negative pressure chamber 5.

Thus, according to the present embodiment, when the suction of the paper sheet P is stopped, the air is positively fed into the negative pressure chamber 5. Moreover, the evacuating of the negative pressure chamber 5 is stopped, whereby as compared with the above second embodiment, an air pressure in the negative pressure chamber 5 can be returned to the atmospheric pressure for a shorter time.

Moreover, at a second timing when a gap between the paper sheet and the subsequent paper sheet P is detected, the control section 10 blocks the connection of the exhaust tube 54, connects the suction tube 52 to the negative pressure chamber 5 and restarts evacuating the chamber.

Also in this case, when the valve unit 56 of the present embodiment is used, a large amount of air can be sucked all together. The pressure in the negative pressure chamber 5 can immediately be decreased to a desired value, and even a heavy paper sheet P having a relatively large size can be adsorbed onto the takeout belt 4.

As described above, according to the present embodiment, an effect similar to the effects of the above first and second embodiments can be produced. Additionally, when the suction of the paper sheet P is stopped, the air pressure in the negative pressure chamber 5 can more immediately be set to the atmospheric pressure, and the response speed can be increased. The gap can more precisely be controlled.

Figure 12:
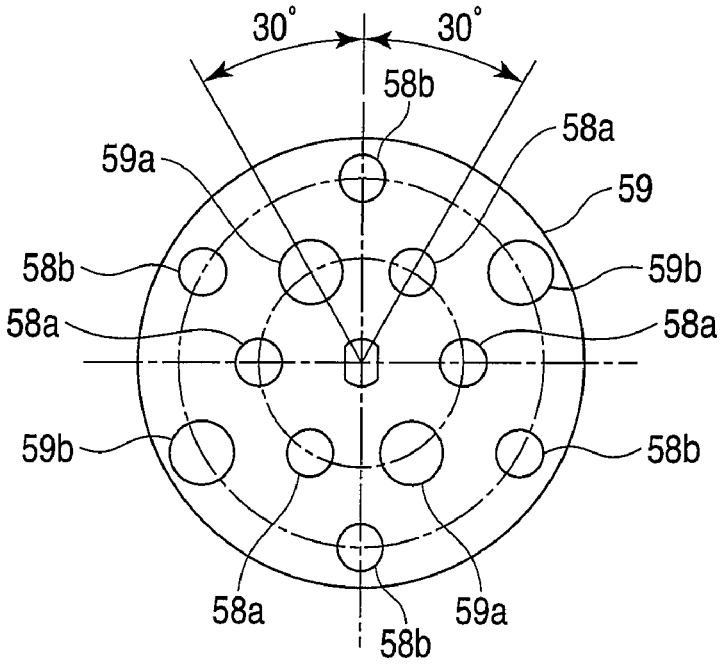
FIG. 12 is a schematic diagram showing a first modification of the shield plate of FIG. 11.

FIG. 12 shows a shield plate 59 according to a first modification of the shield plate 58 of the above third embodiment. This shield plate 59 has several connection holes 59*a*, 59*b* having relatively large diameters unlike the shield plate 58. When this shield plate 59 is used, the diameters of the relatively large connection holes 59*a*, 59*b* are set to diameters substantially equal to those of the suction tube 52 and the exhaust tube 54.

For example, in a case where the connection holes 59*a* having relatively large diameters are selected as inner connection holes which connect the upstream suction tube 52*a* to the downstream suction tube 52*b*, a large amount of air can be sucked all together. When the connection holes 58*a* having relatively small diameters are selected, a relatively small amount of air is sucked. That is, when this shield plate 59 is used, the rotating position of the shield plate 59 can be controlled to change the flow rate of the air to be sucked, and an appropriate adsorption force can be selected in accordance with the size and weight of the paper sheet P to be treated.

Figure 13:
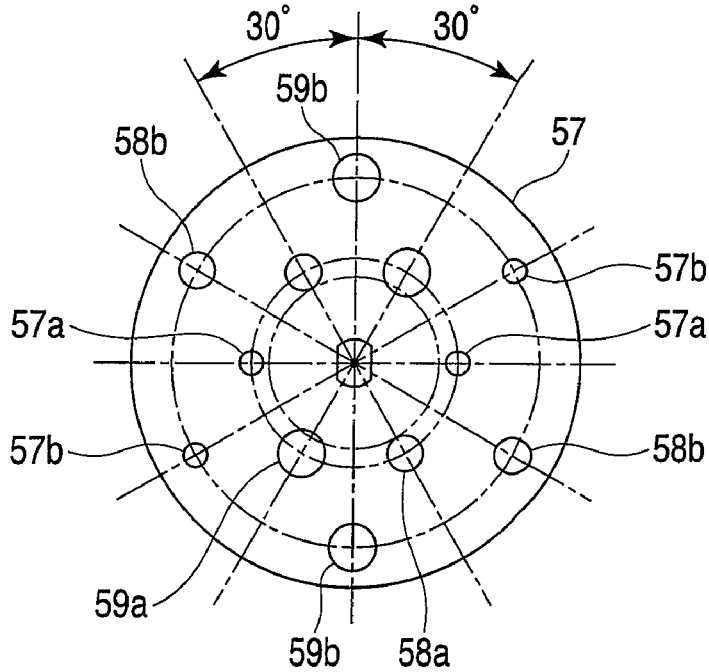
FIG. 13 is a schematic diagram showing a second modification of the shield plate of FIG. 11.

FIG. 13 shows a shield plate 57 according to a second modification of the shield plate 58 of the above third embodiment of the present invention. This shield plate 57 is different from the shield plate 58 in that three types of connection holes having different diameters and connected to the suction tube 52 are prepared and that three types of connection holes having different diameters and connected to the exhaust tube 54 are prepared. When this shield plate 57 is used, the rotating position of the shield plate 57 can be controlled to control the flow rate of the air passing through the suction tube 52 and the flow rate of the air passing through the exhaust tube 54 in three stages.

Figure 14:
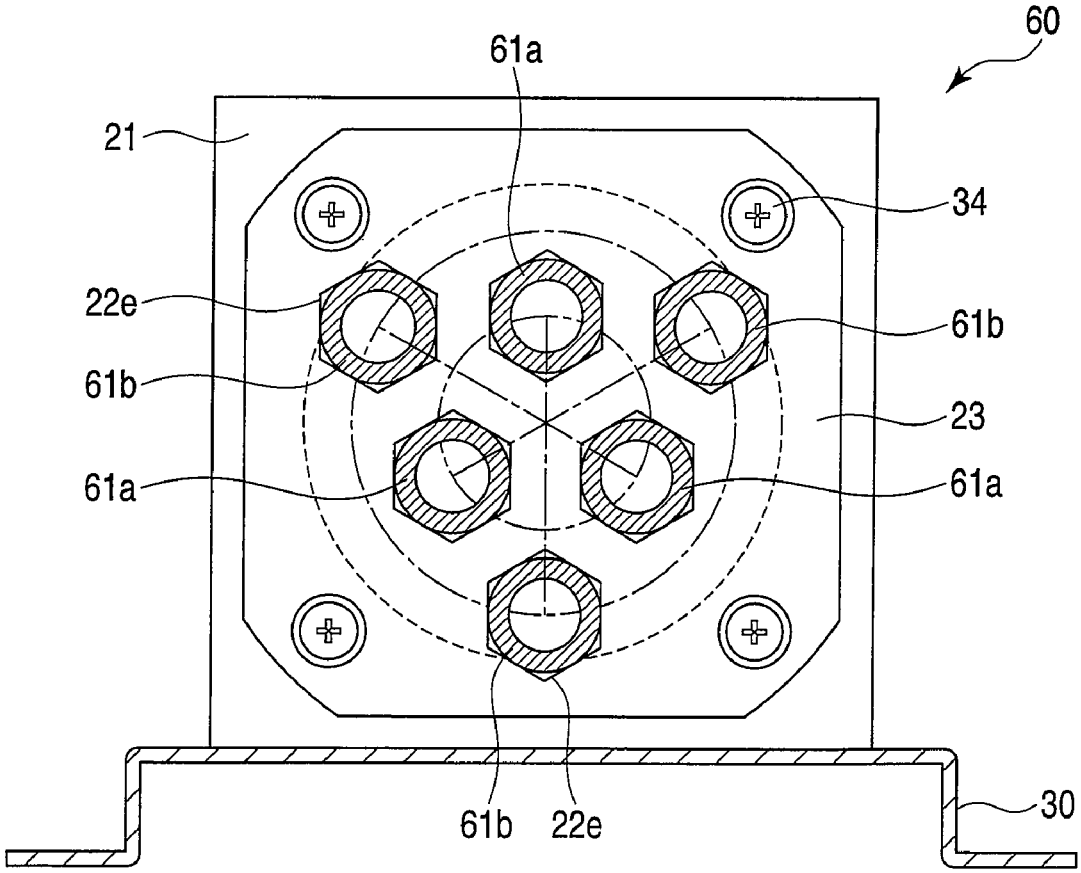
FIG. 14 is a schematic diagram showing a modification of the valve unit of FIG. 6.

Moreover, simply to increase the flow rate of the air passing through the valve unit, as shown in, for example, FIG. 14, the number of pipes 61*a*, 61*b* to be connected to a valve unit 60 may be increased. In this case, pumps need to be increased in accordance with the number of pipes 61.

FIG. 14 is a diagram of the valve unit 60 according to the modification of the valve unit 24 described with reference to FIG. 6 from the back surface of the second block 23. This valve unit 60 is connected to three inner suction pipes 61*a*, and connected to three outer suction tubes 61*b*. It is to be noted that also herein, constituent elements functioning in the same manner as in the first embodiment are denoted with the same reference numerals, and the detailed description thereof is omitted.

For example, in a case where the valve unit 60 of FIG. 14 is used in combination with the shield plate 25 of FIG. 7, every time the shield plate 25 is rotated as much as 30°, all the six suction pipes 61*a*, 61*b* can be opened to and disconnected from the atmosphere. When the six suction pipes 61*a*, 61*b* are opened to the atmosphere, the air can be fed into the negative pressure chamber 5 through the suction pipes all together.

Thus, as a modification in which the number of the pipes to be connected to the valve unit is increased, in addition to the above modification in which the air circulating directions are the same as in the above valve unit 60, a modification of the valve unit is considered in which the air circulating directions are different as in the valve unit 56 of the above third embodiment. In this case, the number of the suction tubes 52 simultaneously controlled to open or close increases. Moreover, the number of the exhaust tubes 54 simultaneously controlled to open or close increases, and the air pressure of the negative pressure chamber 5 can be controlled into a desired value for a shorter time.

Here, the effect of the present invention will be described by comparison between the valve unit 56 of the above third embodiment and the conventional solenoid valve.

Figure 15:
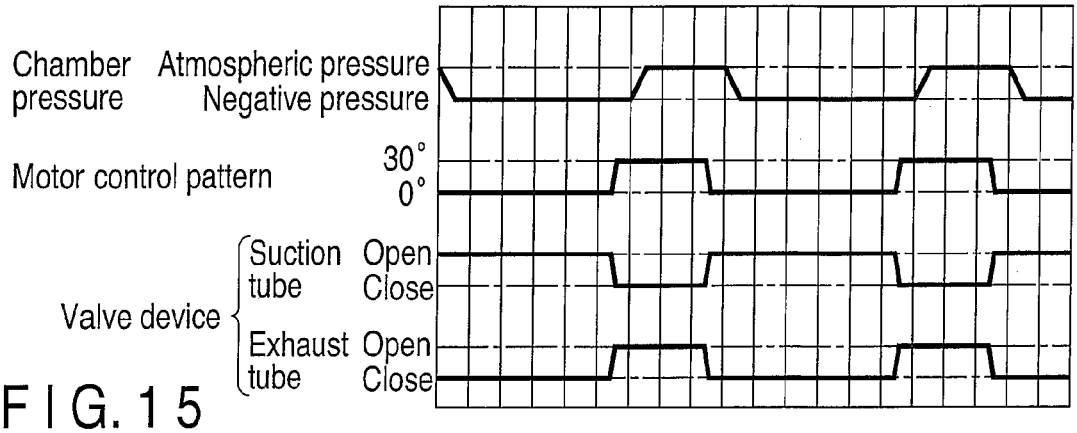
FIG. 15 is a timing chart for explaining a relation between the opening/closing timing of the valve unit of the pressure regulation device of FIG. 9 and an air pressure change in a negative pressure chamber.

FIG. 15 is a timing chart showing an air pressure change in the negative pressure chamber 5 when the opening/closing of the valve unit 56 of the pressure regulation device 50 of FIG. 9 is controlled, together with the control pattern of the motor 27, that is, the opening/closing timing of the valve unit 56. This valve unit 56 alternately opens and closes the suction tube 52 and the exhaust tube 54 as described above.

When this valve unit 56 is used, the control section 10 evacuates the negative pressure chamber 5, takes out the paper sheet P, urges the motor 27 at the above first timing to rotate the shield plate 58 of FIG. 11 as much as 30°, closes the suction tube 52 and simultaneously opens the exhaust tube 54. At this time, the valve unit 56 ends the operation thereof for a remarkably short time simply by rotating the shield plate 58 as much as 30°. Therefore, immediately after the control section 10 outputs a driving signal to the motor 27, the valve unit 56 ends the switching of the flow path, and the negative pressure chamber 5 is immediately released to the atmospheric pressure.

On the other hand, when the shield plate 58 is further rotated as much as 30° at the above second timing, or returned as much as 30°, the valve unit 56 can simultaneously and immediately open or close two flow paths. Therefore, also when the negative pressure chamber 5 is evacuated, the suction can be started for a short time. That is, according to this valve unit 56, the flow path can be opened or closed simply by an operation for slightly rotating the shield plate 58, whereby the inertia is small and the response speed is high.

Figure 16:
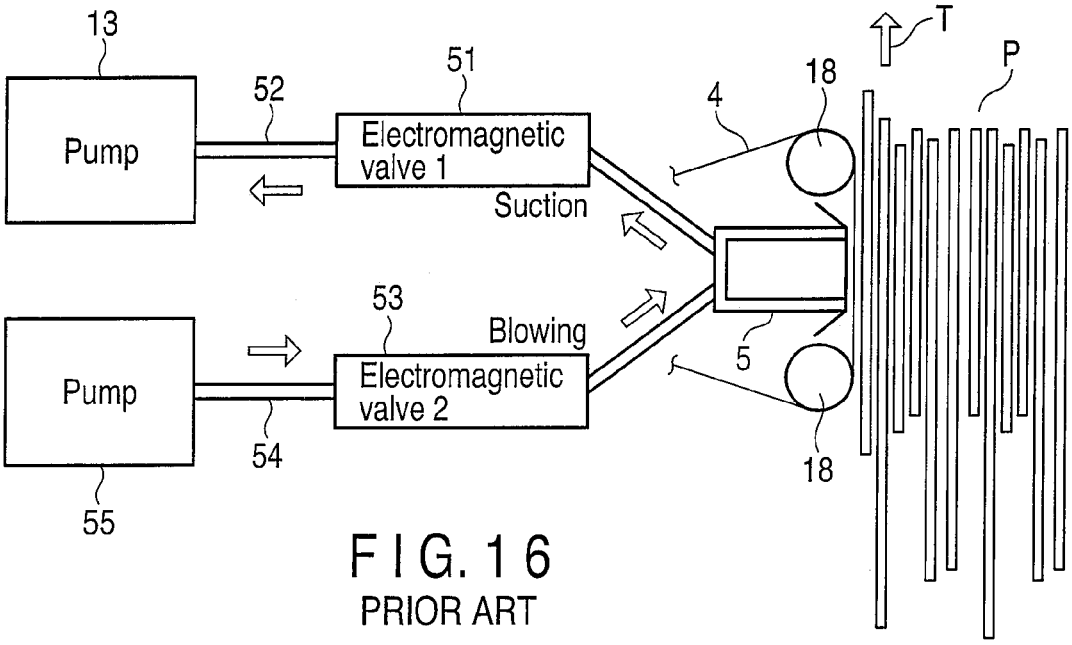
FIG. 16 PRIOR ART
FIG. 16 is a schematic diagram showing one example of a takeout device using a conventional solenoid valve.

On the other hand, FIG. 16 shows the structure of a main portion of a takeout device using the conventional solenoid valve. Here, to describe the structure in comparison with the device of FIG. 9, constituent elements which similarly function are denoted with the same reference numerals. In this device, a solenoid valve 51 (an electromagnetic valve 1) is attached to the middle of a suction tube 52 connected to a pump 13 for evacuating a negative pressure chamber 5, and another solenoid valve 53 (an electromagnetic valve 2) is attached to the middle of an exhaust tube 54 connected to a pump 55 for feeding air into the negative pressure chamber 5.

Figure 17:
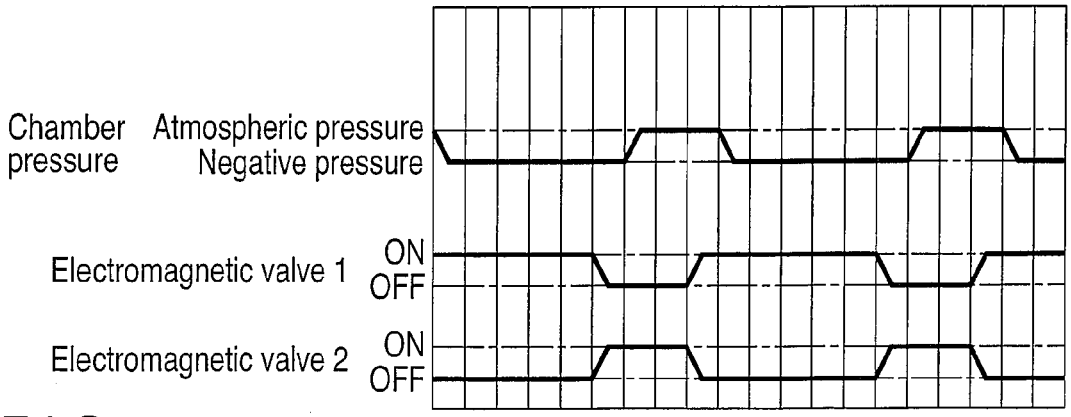
FIG. 17 PRIOR ART
FIG. 17 is a timing chart for explaining a relation between the switch timing of a solenoid valve of the takeout device of FIG. 16 and an air pressure change in a negative pressure chamber.

Thus, when the conventional solenoid valves 51, 53 are used, as shown in FIG. 17, a control section 10 evacuates the negative pressure chamber 5, takes out a paper sheet P, turns off the electromagnetic valve 51 of the suction tube 52, and turns on the electromagnetic valve 53 of the exhaust tube 54 at a first timing. In consequence, the evacuating of the negative pressure chamber 5 is discontinued. Moreover, the air is fed into the negative pressure chamber 5, and the negative pressure chamber 5 is opened to the atmosphere.

However, for example, when the electromagnetic valve 51 is turned off, a plunger (not shown) is pushed into a chamber (not shown) connected to the suction tube 52 to block a flow path, but an only short time is required for blocking the flow path owing to the inertia of the plunger. Moreover, when the electromagnetic valve 53 is turned on, an only short time is required for opening the flow path owing to the inertia of the plunger. Therefore, in the device using the conventional solenoid valves 51, 53, the control section 10 requires a relatively long time for setting an air pressure in the negative pressure chamber 5 to the atmospheric pressure after outputting a driving signal to the electromagnetic valve.

This also applies to a case where the negative pressure chamber 5 is evacuated by using the conventional solenoid valves 51, 53. The response speed of the solenoid valve is low, and hence much time is required for starting the suction of the negative pressure chamber 5.

That is, in a case where the pressure change (FIG. 15) of the negative pressure chamber 5 during the use of the valve unit 56 of the third embodiment of the present invention is compared with the pressure change (FIG. 17) of the negative pressure chamber 5 during the use of the conventional solenoid valves 51, 53, it is seen that when the valve unit 56 of the present invention is used, the response speed can be increased as compared with when the solenoid valves are used.

Hereinafter, another embodiment of the present invention will further be described.

Figure 18:
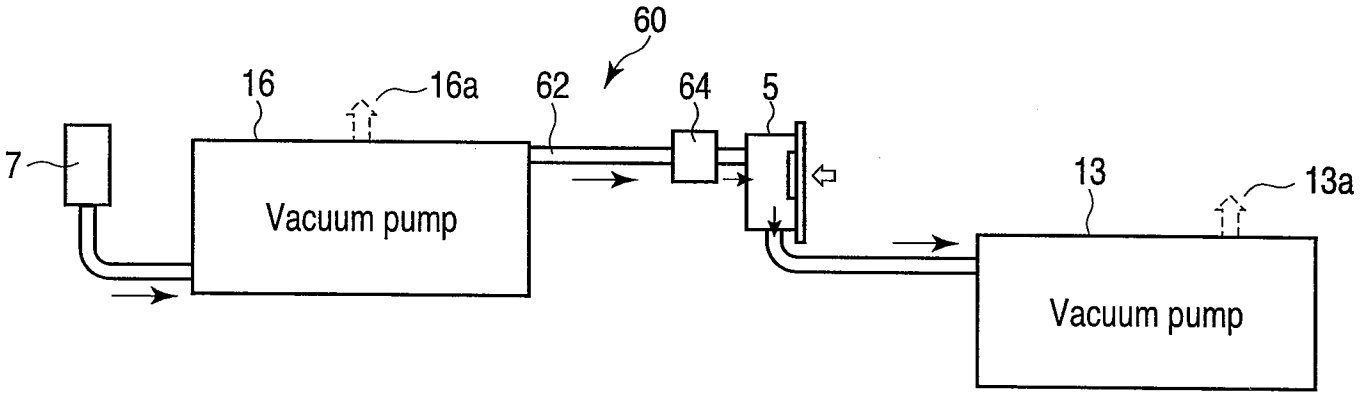
FIG. 18 is a schematic diagram of a main portion showing a takeout device including a pressure regulation device according to a fourth embodiment of this invention.

FIG. 18 schematically shows the structure of a main portion of a takeout device 1 including a pressure regulation device 60 according to a fourth embodiment of this invention. This pressure regulation device 60 is characterized in that instead of feeding the exhaust gas of the pump 13 into the negative pressure chamber 5 at the above first timing, the exhaust air of another pump 16 is fed into the negative pressure chamber 5, and the device is different from the pressure regulation device 40 (FIG. 8) of the second embodiment in this respect.

That is, the pressure regulation device 60 of the present embodiment has a structure in which a valve unit 64 is attached to the middle of an exhaust tube 62 of the pump 16 for evacuating the chamber 7*a* of the core 7*b* of the separation roller 7. This valve unit 64 has substantially the same structure as in the valve unit 24 of the above first embodiment and the valve unit 44 of the above second embodiment, hence similarly functions and is operated at the same timing as in these valve units 24, 44.

It is to be noted that in the present embodiment, the exhaust gas of the pump 16 of the separation roller 7 is used, but the present invention is not limited to this embodiment, and the exhaust gas of the blower 14 for sucking the suction chamber 6 may be used, or a blower for exclusive use (not shown) may be connected to the negative pressure chamber 5.

During the takeout of the paper sheet P, the control section 10 of the takeout device 1 closes the valve unit 64 provided halfway in the exhaust tube 62 of the pump 16 to evacuate the negative pressure chamber 5 by the pump 13. At this time, the pump 16 for generating the negative pressure on the outer peripheral surface of the separation roller 7 continues a sucking operation, but air sucked by a relief valve 16*a* is released.

Then, at the above first timing, the control section 10 opens the electromagnetic valve 64 to feed the exhaust gas of the pump 16 into the negative pressure chamber 5. In consequence, an effect similar to that of the above second embodiment can be produced. That is, at the first timing, the large amount of the air can be fed into the negative pressure chamber 5, and the air pressure in the negative pressure chamber 5 can immediately be returned to the atmospheric pressure.

Figure 19:
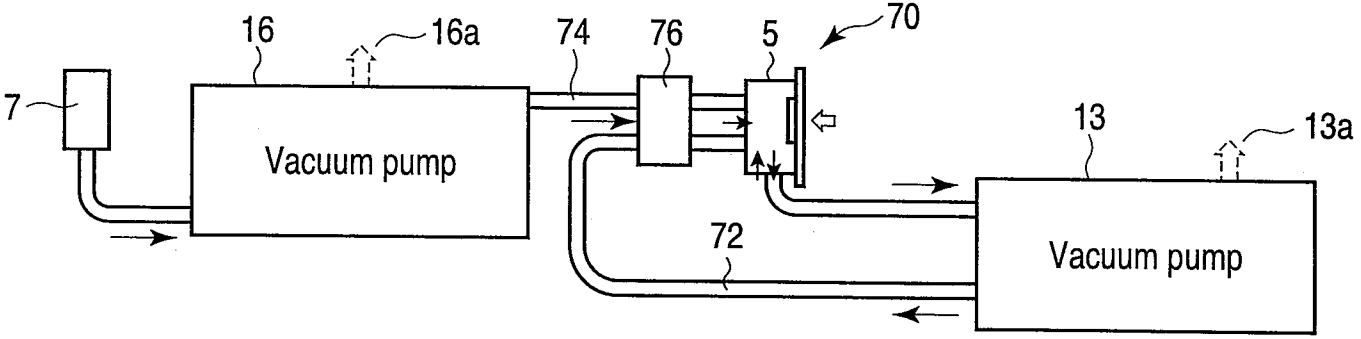
FIG. 19 is a schematic diagram of a main portion showing a takeout device including a pressure regulation device according to a fifth embodiment of this invention.

FIG. 19 schematically shows the structure of a main portion of a takeout device 1 including a pressure regulation device 70 according to a fifth embodiment of this invention. This pressure regulation device 70 has a structure obtained by combining the pressure regulation device 40 (FIG. 8) according to the above second embodiment with the pressure regulation device 60 (FIG. 18) according to the above fourth embodiment.

That is, an exhaust tube 72 of a pump 13 for evacuating a negative pressure chamber 5 is connected to the negative pressure chamber 5, and an exhaust tube 74 of a pump 16 of a separation roller 7 is connected to the negative pressure chamber 5. Halfway in the two exhaust tubes 72, 74, one common valve unit 76 is attached. This valve unit 76 has the same structure as that of the valve unit 24 (FIG. 5) according to the above first embodiment, and simultaneously opens or closes the two exhaust tubes 72, 74.

In the present embodiment, during the takeout of the paper sheet P, the control section 10 closes the valve unit 76 to evacuate the negative pressure chamber 5 by the pump 13, and runs the takeout belt 4 to take out the paper sheet P. Then, at the above first timing, the control section 10 opens the valve unit 76, feeds the large amount of the air into the negative pressure chamber 5 through the two exhaust tubes 72, 74, and immediately returns the air pressure in the negative pressure chamber 5 to the atmospheric pressure, to prevent a defect that the second and subsequent paper sheets P are adsorbed onto the takeout belt 4.

In the present embodiment, at the first timing, the valve unit 76 can be opened to feed the large amount of the air into the negative pressure chamber 5 all together, and the air pressure in the negative pressure chamber 5 can immediately be returned to the atmospheric pressure, whereby the gap between the paper sheets P to be taken out can precisely be controlled into a desired size.

Figure 20:
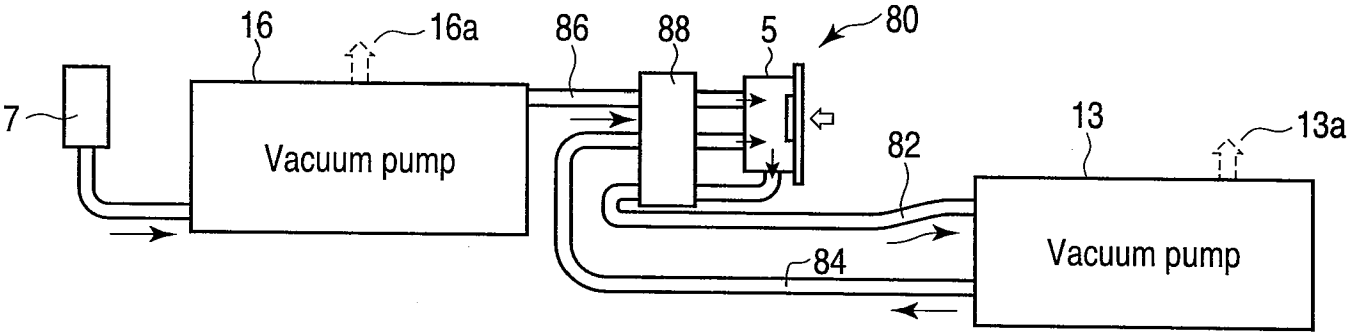
FIG. 20 is a schematic diagram of a main portion showing a takeout device including a pressure regulation device according to a sixth embodiment of this invention.
Figure 21:
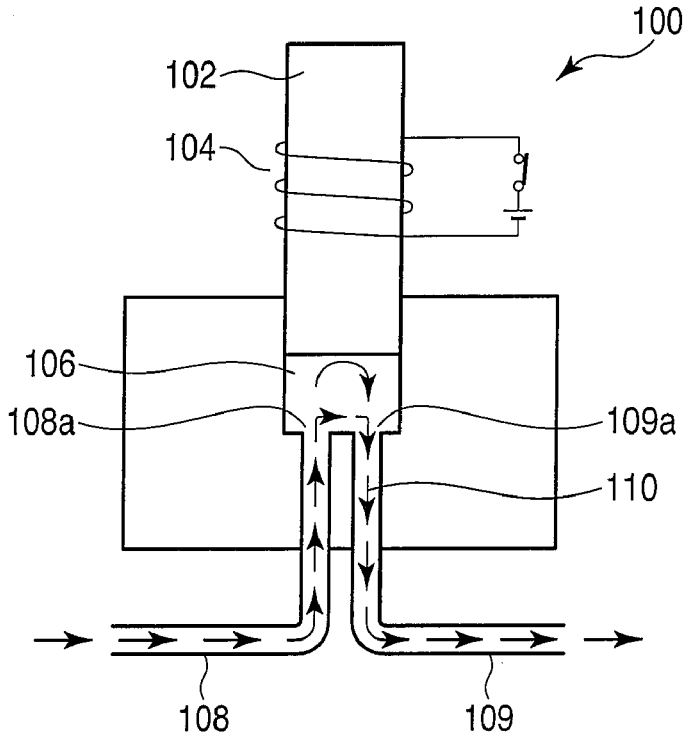
FIG. 21 PRIOR ART
FIG. 21 is a schematic diagram showing that a conventional solenoid valve is opened.
Figure 22:
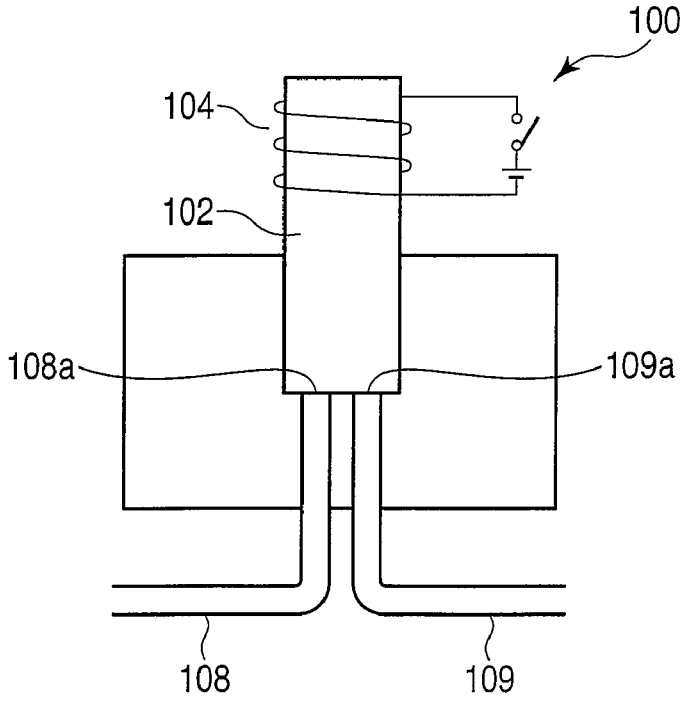
FIG. 22 PRIOR ART
FIG. 22 is a schematic diagram showing that the solenoid valve of FIG. 21 is closed.

FIG. 20 schematically shows the structure of a main portion of a takeout device 1 including a pressure regulation device 80 according to a sixth embodiment of this invention. This pressure regulation device 80 has a structure obtained by combining the structure of the pressure regulation device 70 of the above fifth embodiment with the structure of the pressure regulation device 50 described with reference to FIG. 9.

That is, the device has a structure in which a suction tube 82 of a vacuum pump 13 for evacuating a vacuum chamber 5, an exhaust tube 84 of the vacuum pump 13 and an exhaust tube 86 of a vacuum pump 16 of a separation roller 7 are connected to the negative pressure chamber 5. Halfway in the suction tube 82 and the two exhaust tubes 84, 86, one common valve unit 88 is provided.

This valve unit 88 includes a shield plate (not shown) having at least two connection holes (not shown) simultaneously connected to the two exhaust tubes 84, 86 while the connection of the suction tube 82 is blocked, and having at least one connection hole (not shown) connected to the suction tube 82 while the connection of two exhaust tubes 84, 86 is simultaneously blocked. That is, this valve unit 88 functions so as to block the connection of the valve unit and the suction tube 82 while the shield plate is rotated by a specific angle and stopped and to simultaneously connect the two exhaust tubes 84, 86 to each other. The valve unit is further connected to the suction tube 82 while the shield plate is rotated by another specific angle and stopped, and simultaneously blocks the connection of two exhaust tubes 84, 86.

When this pressure regulation device 80 is used, at the first timing, the air pressure in the negative pressure chamber 5 can immediately be returned to the atmospheric pressure, and the highest treatment efficiency of the takeout device 1 can be obtained. That is, at the first timing, the connection of the suction tube 82 is blocked, and the two exhaust tubes 84, 86 are simultaneously connected to each other, whereby the evacuating of the negative pressure chamber 5 is stopped, and the large amount of the air can simultaneously be fed into the chamber 5 all together. The air pressure in the negative pressure chamber 5 can immediately be returned to the atmospheric pressure.

As described above, according to the present invention, when the negative pressure generated on the surface of the takeout belt 4 is eliminated to stop the adsorption of the paper sheet P, the large amount of the air is positively fed into the negative pressure chamber 5 to immediately eliminate the negative pressure. Therefore, it is possible to prevent a defect that the negative pressure remains and that the next paper sheet P is unexpectedly adsorbed onto the belt. In consequence, at a desired timing, the paper sheet P can be taken and adsorbed onto the takeout belt 4. The takeout period of the paper sheet P can be speeded up, and the gap between the paper sheets P can be stabilized.

In particular, when the valve unit of the present invention is used, the flow rate of the air can easily be controlled, and the large amount of the air can immediately be fed into the negative pressure chamber, whereby the response speed for eliminating the negative pressure can be increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above embodiments, the endless takeout belt 4 has been described as a takeout member for taking out the paper sheet P supplied to the takeout position S, but the present invention is not limited to this embodiment, and a takeout member may be used in which a plurality of adsorption holes are formed in a rotor rotating in a takeout direction.

Moreover, in the above embodiments, there has been described a case where the connection holes 25*a*, 25*b*, 57*a*, 57*b*, 58*a*, 58*b*, 59*a* and 59*b* of the shield plates 25, 57, 58 and 59 are formed into a circular shape in accordance with the sectional shape of the pipes, but the present invention is not limited to the embodiments, and the connection holes may be formed into another shape such as a quadrangular shape. Hereinafter, several modifications including connection holes having different shapes will be described.

Figure 23A:
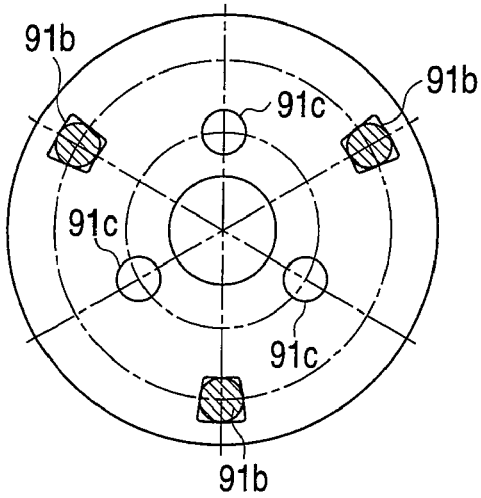
FIG. 23A is a diagram showing a third modification of the shield plate.
Figure 23B:
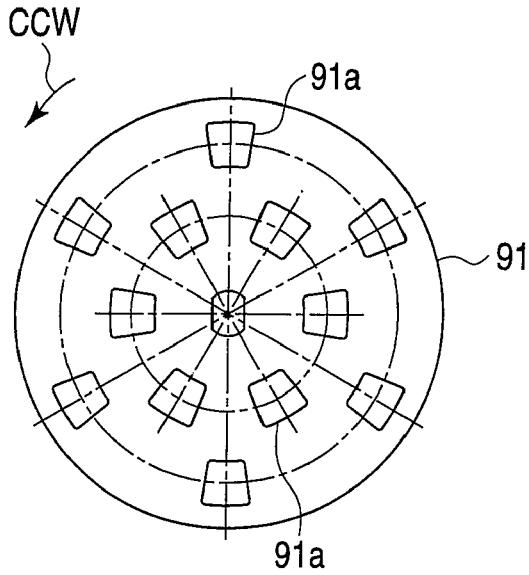
FIG. 23B is a diagram for explaining the opened/closed state of a flow path in a case where the shield plate of FIG. 23A is used.

FIG. 23B shows a shield plate 91 having a plurality of substantially quadrangular connection holes 91*a* as a third modification. Moreover, FIG. 23A shows, as one example, a diagram for explaining the opened/closed state of a flow path in a case where this shield plate 91 is used in combination with the valve unit 60 of FIG. 14.

That is, when the shield plate 91 is stopped in a rotating position shown in FIG. 23B, three outer flow paths 91*b* hatched in FIG. 23A are fully opened, and three inner flow paths 91*c* are closed. When the shield plate 91 is rotated from this state as much as 30° in, for example, a counterclockwise direction (the CCW direction) (an arrow direction in the drawing), the three outer flow paths 91*b* are then closed, and the three inner flow paths 91*c* are fully opened. A space between the inner flow paths 91*c* is smaller than that between the outer flow paths 91*b*, and hence in the present modification, the inner flow paths 91*c* start opening while the outer flow paths 91*b* is closing.

At this time, for example, if the shield plate including circular connection holes having sectional areas equal to those of the flow paths as in the above embodiments is used, during the opening of the inner flow paths 91*c*, the circular connection holes of the shield plate gradually coincide with the circular flow paths. Therefore, the increase ratio of an open area during the start of the opening of the flow paths 91*c* is relatively small, and the rising of the increase of the open area before fully opening the flow paths 91*c* becomes slightly moderate.

On the other hand, in a case where the shield plate 91 including the quadrangular connection holes 91*a* having sizes to cover the whole sectional areas of the flow paths 91*c* is used as in the present modification, when the inner flow paths 91*c* are opened as described above, the front edges of the quadrangular connection holes 91*a* in a moving direction (the CCW direction) first coincide with the circular flow paths 91*c*, the increase ratio of the open area becomes steep. That is, in a case where the shield plate 91 having the quadrangular connection holes 91*a* is used as in the present modification, when the flow paths 91*c* start opening, a large amount of air can be circulated, and the response speed of the valve unit 60 can further be increased.

Figure 24A:
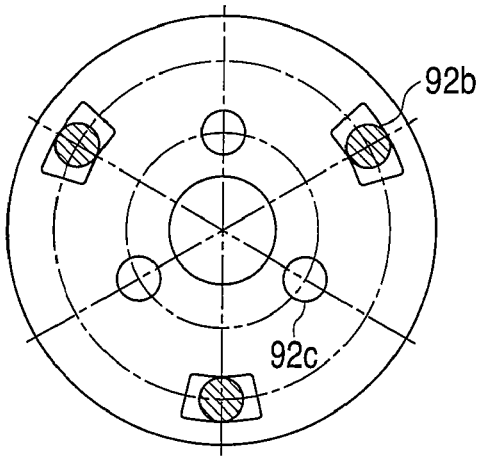
FIG. 24A is a diagram showing a fourth modification of the shield plate.
Figure 24B:
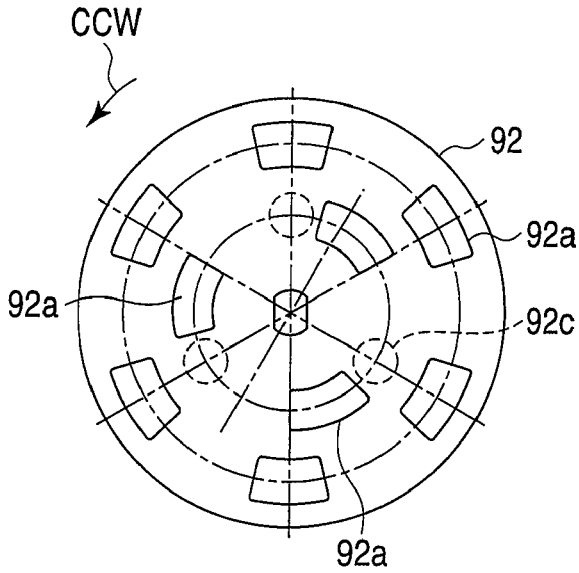
FIG. 24B is a diagram for explaining the opened/closed state of a flow path in a case where the shield plate of FIG. 24A is used.

FIG. 24B shows, as a fourth modification, a shield plate 92 having a plurality of connection holes 92*a* lengthened along a rotating direction. Moreover, FIG. 24A shows a diagram for explaining the opened/closed states of flow paths in a case where this shield plate 92 is used. Since the connection holes 92*a* are lengthened along the rotating direction, the number of the inner connection holes 92*a* is decreased in the present modification.

Also in this modification, the front edge of each connection hole 92*a* in the moving direction (the CCW direction) linearly extends along the diametric direction of the shield plate 92, whereby in the same manner as in the above third modification, the rising during the opening of the flow paths can become steep, and the response speed of the valve unit 60 can be increased.

Furthermore, according to this modification, a time required for fully opening the flow paths of the valve unit 60 can further be shortened. That is, in the present modification, the connection holes 92*a* of the shield plate 92 are lengthened along the rotating direction, whereby after fully opening the flow paths, the fully opened state can be kept during deceleration for stopping the rotation of the shield plate 92. Therefore, as compared with the above third modification, a time required for maximizing the flow rate can be shortened. In other words, according to the present modification, when the flow paths are opened, the flow paths can fully be opened during acceleration for rotating the shield plate 92 from a stopped state, and a time required for decelerating and stopping the shield plate 92 does not have to be considered.

Specifically, when the shield plate 92 stopped in the rotating position shown in FIG. 24B (the outer flow paths are fully opened) is rotated in the arrow CCW direction, the three inner connection holes 92*a* of the shield plate 92 immediately start to coincide with inner flow paths 92*c* (shown by broken lines in FIG. 24B), respectively, and the three inner flow paths 92*c* are fully opened during the acceleration of the shield plate 92. Afterward, when the shield plate 92 is decelerated and stopped, the fully opened states of the flow paths 92*c* are kept as they are, and the shield plate 92 is rotated while being decelerated, whereby the shield plate is stopped while the flow paths 92*c* are fully opened.

On the other hand, in a case where the shield plate has the relatively short connection holes 91*a* substantially having lengths equal to the diameters of the flow paths as in the shield plate 91 of the above third modification, when the connection holes 91*a* coincide with the flow paths, the rotation of the shield plate 91 needs to be stopped, and hence a time for decelerating the shield plate 91 is required until the flow paths are fully opened. On the other hand, according to the present modification, the flow paths can fully be opened for a short time to accelerate the shield plate 92, and the time required for fully opening the flow paths can be shortened.

Figure 25A:
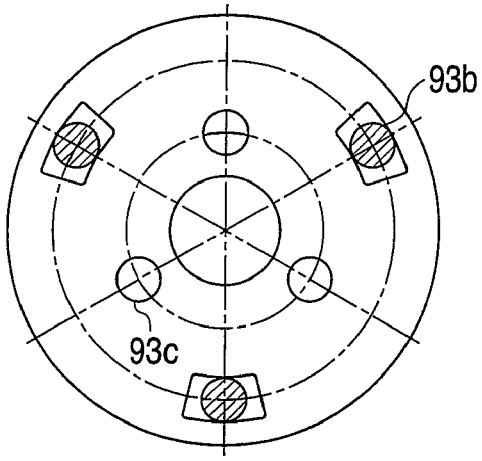
FIG. 25A is a diagram showing a fifth modification of the shield plate.
Figure 25B:
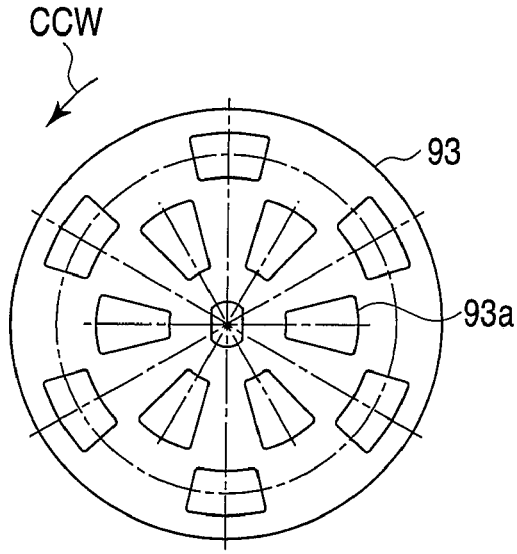
FIG. 25B is a diagram for explaining the opened/closed state of a flow path in a case where the shield plate of FIG. 25A is used.

FIG. 25B shows a shield plate 93 as a fifth modification, and FIG. 25A shows a diagram for explaining the opened/closed states of flow paths in a case where this shield plate 93 is used. This shield plate 93 is different from the shield plate 92 of the above fourth modification in that inner connection holes 93*a* extend in a diametric direction and that the number of the inner connection holes 93*a* is large.

Also in this modification, the front edge of each connection hole 93*a* along a rotating direction CCW linearly extends along the diametric direction of the shield plate 93, whereby the rising of the increase of an open area during the opening of the flow paths can become steep, and the response speed of the valve unit can be increased.

Figure 26A:
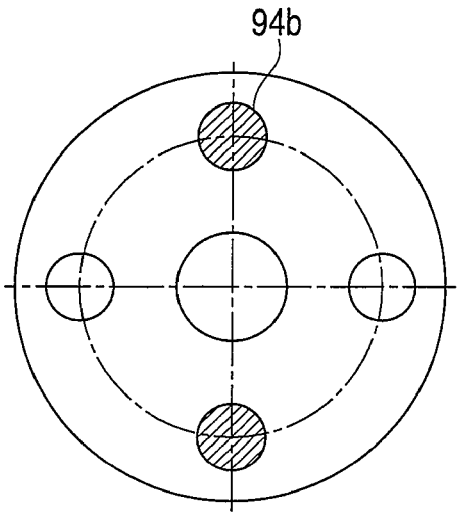
FIG. 26A is a diagram showing a sixth modification of the shield plate.
Figure 26B:
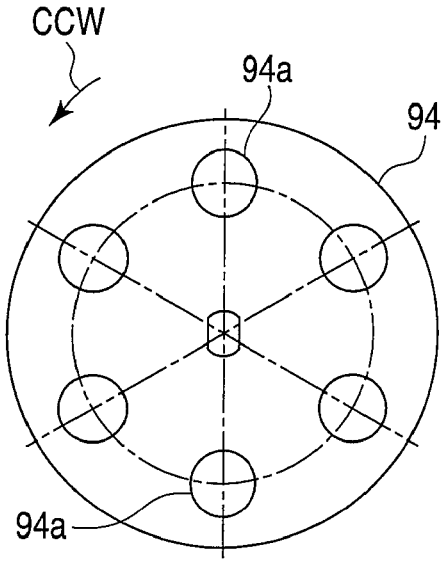
FIG. 26B is a diagram for explaining the opened/closed state of a flow path in a case where the shield plate of FIG. 26A is used.

FIG. 26B shows, as a sixth modification, a shield plate 94 including a plurality of connection holes 94*a* only on the same circumference. FIG. 26A shows a diagram for explaining the opened/closed states of flow paths in a case where this shield plate 94 is used.

Thus, even in a case where the connection holes 94*a* are arranged on the same circumference, when the positions of the flow paths on the side of the valve unit are set to those shown in FIG. 26A, several flow paths 94*b* can selectively be opened. Moreover, in a case where the connection holes 94*a* are arranged along the same circumference as in this modification, the opening/closing conditions of the flow paths can be the same as those in a case where the connection holes are arranged on the inner and outer sides of the shield plate as in the above third to fifth modifications.

Figure 27A:
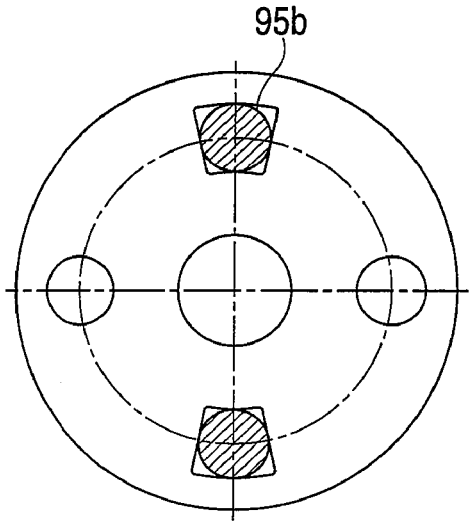
FIG. 27A is a diagram showing a seventh modification of the shield plate.
Figure 27B:
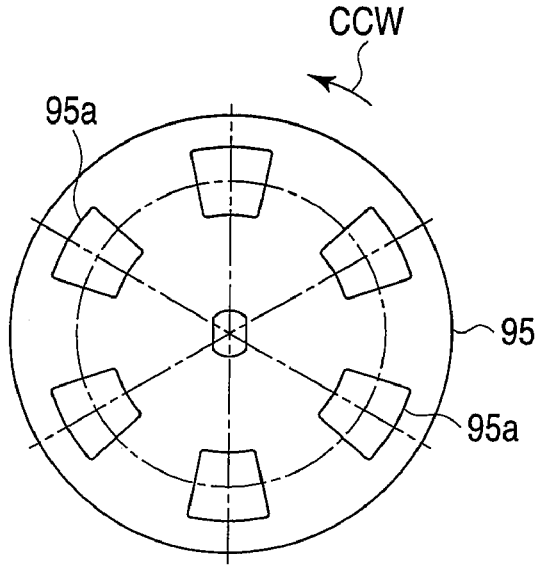
FIG. 27B is a diagram for explaining the opened/closed state of a flow path in a case where the shield plate of FIG. 27A is used.

FIG. 27B shows a shield plate 95 as a seventh modification, and FIG. 27A shows a diagram for explaining the opened/closed states of flow paths in a case where this shield plate 95 is used. This shield plate 95 is different from the above sixth modification in that the plate has quadrangular connection holes 95*a*.

According to this modification, an effect similar to that of the above sixth modification can be produced. Additionally, as in the above third to fifth modifications, the rising of the increase of an open area during the opening of the flow paths can be steep, and the response speed of the valve unit can be increased.

What is claimed is:

1. A valve unit which switches an opened state where a first flow path is connected to a second flow path and a closed state where the connection of the first flow path and the second flow path is blocked, the valve unit comprising:

a first member having a first facing surface which faces the second flow path, and a first hole provided with one end connected to the first flow path and the other end exposed to the first facing surface;

a second member having a second facing surface which faces the first facing surface via a space, and a second hole provided with one end connected to the second flow path and the other end facing the first hole and exposed to the second facing surface;

a shield plate rotatably disposed in the space along the first and second facing surfaces, having a plurality of connection holes away from the rotation center thereof each of which are configured to connect the first hole to the second hole during rotation and to connect the first hole to the second hole and block the connection thereof; and a rotator which rotates the shield plate between the opened state where the connection holes coincide with the first and second holes and the closed state where the connection of the first and second holes is blocked, wherein a plurality of sets of the first and second flow paths are provided, the first and second members having a plurality of sets of the first and second holes corresponding to the plurality of the sets of the first and second flow paths, each set of first and second holes is provided at a position with different distances from the rotational center of the shield plate, wherein the plurality of connection holes of the shielding plate are configured such that each of the plurality of connection holes are equidistantly disposed on different circumferences corresponding to each set of the first and second holes.

2. A paper sheet takeout device comprising:

a throwing section into which a plurality of paper sheets are loaded in a stacked state;

a takeout member having adsorption holes and running along a paper sheet at one end in a superimposing direction of the paper sheets thrown into the throwing section;

a single negative pressure chamber which sucks the adsorption holes from the backside of the takeout member to generate a negative pressure on the surface of the takeout member, thereby adsorbing the paper sheet at the one end onto the surface of the takeout member;

a first pipe configured to suck air from the single negative pressure chamber;

a second pipe configured to feed air into the single negative pressure chamber; and a single valve unit provided halfway in the first pipe and the second pipe, the single valve unit switches to a first state where the valve unit communicates with the first pipe while blocking the second pipe and a second state where the valve unit communicates with the second pipe while blocking the first pipe, the single valve unit comprising:

a first member having a first facing surface, a first hole provided with one end connected to the first pipe and the other end exposed to the first facing surface, and a second hole provided with one end connected to the second pipe and the other end exposed to the first facing surface;

a second member having a second facing surface which faces the first facing surface via a space, a third hole provided with one end connected to the first pipe and the other end facing the first hole and exposed to the second facing surface, and a fourth hole provided with one end connected to the second pipe and the other end facing the second hole and exposed to the second facing surface;

a shield plate rotatably disposed in the space along the first and second facing surfaces, and having a first connection hole away from the rotation center thereof which connects the first hole to the third hole during rotation and a second connection hole away from the rotation center thereof which connects the second hole to the fourth hole during the rotation; and a rotator which rotates the shield plate at the first state where the first connection hole coincides with the first and third holes and the second state where the second connection hole coincides with the second and fourth holes.

3. The paper sheet takeout device according to claim 2, wherein a front edge in rotational direction of the first and second connection holes of the shield plate extends along a radial direction of the shield plate.

4. The paper sheet takeout device according to claim 2, wherein each of the first and second holes are disposed at a position with different distances from the rotation center thereof.

5. The paper sheet takeout device according to claim 2, further comprising a single pump having an exhaust port connected to the second pipe and a suction port connected to the first pipe.

6. A valve unit, provided with a plurality of sets of first and second flow paths, and configured to switch between an opened state where the first flow path is connected to the second flow path and a closed state where the connection of the first flow path and the second flow path is blocked, the valve unit comprising:

a first member having a first facing surface which faces the second flow path, and a plurality of sets of first holes provided with one end connected to each of the plurality of sets of the first flow paths and the other end exposed to the first facing surface;

a second member having a second facing surface which faces the first facing surface via a space, and a plurality of sets of second holes provided with one end connected to each of the plurality of sets of the second flow paths and the other end facing the first hole and exposed to the second facing surface;

a shield plate, disposed in the space rotatably along the first and second facing surfaces, having a plurality of connection holes provided at a position with different distances from the rotation center thereof which connects the first hole to the second hole during rotation, and configured to connect the first hole to the second hole and block the connection thereof; and a rotator which rotates the shield plate between the opened state where the connection hole coincides with the first and second holes and the closed state where the connection of the first and second holes is blocked, wherein each of the connection holes are shaped only to be connected to a single first hole and a single second hole.

7. A paper sheet takeout device comprising:

a throwing section into which a plurality of paper sheets are loaded in a stacked state;

a takeout member having adsorption holes and running along a paper sheet at one end in a superimposing direction of the paper sheets thrown into the throwing section;

a single negative pressure generating section which sucks the adsorption holes from the backside of the takeout member to generate a negative pressure on the surface of the takeout member, thereby adsorbing the paper sheet at the one end onto the surface of the takeout member;

a first pipe configured to suck air from the single negative pressure generating section;

a second pipe configured to feed air into the single negative pressure generating section; and a single valve unit provided halfway in the first pipe and the second pipe, the single valve unit provided with a plurality of sets of first and second flow paths, and configured to switch between an opened state where the first flow path is connected to the second flow path and a closed state where the connection of the first flow path and the second flow path is blocked, the valve unit including:

a first member having a first facing surface which faces the second flow path, and a plurality of sets of the first holes provided with one end connected to each of the plurality of sets of the first flow paths and the other end exposed to the first facing surface;

a second member having a second facing surface which faces the first facing surface via a space, and a plurality of sets of the second holes provided with one end connected to each of the plurality of sets of the second flow paths and the other end facing the first hole and exposed to the second facing surface;

a shield plate rotatably disposed in the space along the first and second facing surfaces, having a plurality of connection holes provided at a position with different distances from the rotation center thereof which connects the first hole to the second hole during rotation, and configured to connect the first hole to the second hole and block the connection thereof; and a rotator which rotates the shield plate between the opened state where the connection hole coincides with the first and second holes and the closed state where the connection of the first and second holes is blocked, wherein each of the connection holes are shaped only to be connected to the single first hole and the single second hole.

8. The paper sheet takeout device according to claim 7, wherein each the plurality of connection holes are configured such that the connection holes are equidistantly disposed along a different circumference centered around a rotational center of the shielding plate.

9. The paper sheet takeout device according to claim 7, further comprising a single pump having an exhaust port connected to the second pipe and a suction port connected to the first pipe.

10. The paper sheet takeout device according to claim 2, wherein the first and second connecting holes are plurally and equidistantly disposed along a same circumference centered around a rotational center of the shielding plate.

* * * * *